US007923183B2

(12) United States Patent
Ito

(10) Patent No.: US 7,923,183 B2
(45) Date of Patent: Apr. 12, 2011

(54) IMAGE FORMING APPARATUS AND IMAGE FORMING METHOD

(75) Inventor: Isao Ito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1090 days.

(21) Appl. No.: 11/604,031

(22) Filed: Nov. 24, 2006

(65) Prior Publication Data

US 2007/0218375 A1 Sep. 20, 2007

(30) Foreign Application Priority Data

Mar. 20, 2006 (JP) ..... 2006-077360

(51) Int. Cl.
*G03G 15/01* (2006.01)
*G03G 15/00* (2006.01)

(52) U.S. Cl. ..... 430/45.33; 430/108.1; 430/110.2; 430/110.3; 399/298; 399/321

(58) Field of Classification Search ..... 430/45.33, 430/108.1, 110.2, 110.3; 399/298, 321
See application file for complete search history.

(56) References Cited

U.S. PATENT DOCUMENTS

| | | | | |
|---|---|---|---|---|
| 4,624,543 | A * | 11/1986 | Young et al. | 358/300 |
| 6,303,259 | B1 * | 10/2001 | Kubo et al. | 430/138 |
| 7,642,024 | B2 * | 1/2010 | Furuya | 430/56 |

FOREIGN PATENT DOCUMENTS

| | | | |
|---|---|---|---|
| GB | 2 223 604 A | | 4/1990 |
| JP | 2-97943 | | 4/1990 |
| JP | 2-293869 | | 12/1990 |
| JP | A-63-311364 | | 12/1998 |
| JP | 2003-330228 | * | 11/2003 |
| JP | A-2003-330228 | | 11/2003 |

OTHER PUBLICATIONS

Unpublished U.S. Appl. No. 11/603,842, filed Nov. 24, 2006 (Kimura et al.).
Unpublished U.S. Appl. No. 11/603,979, filed Nov. 24, 2006 (Maeyama).
Unpublished U.S. Appl. No. 11/603,980, filed Nov. 24, 2006 (Furuya).
Unpublished U.S. Appl. No. 11/604,024, filed Nov. 24, 2006 (Hara et al.).
Unpublished U.S. Appl. No. 11/604,025, filed Nov. 24, 2006 (Kashimura).
Unpublished U.S. Appl. No. 11/604,036, filed Nov. 24, 2006 (Kimura et al.).
Unpublished U.S. Appl. No. 11/604,044, filed Nov. 24, 2006 (Ito).
Unpublished U.S. Appl. No. 11/604,048, filed Nov. 24, 2006 (Kimura et al.).
Unpublished U.S. Appl. No. 11/604,049, filed Nov. 24, 2006 (Takegawa).

* cited by examiner

*Primary Examiner* — Thorl Chea
(74) *Attorney, Agent, or Firm* — Morgan, Lewis & Bockius LLP

(57) ABSTRACT

An image forming apparatus includes: an image holding member; a toner image formation device that forms a toner image using a toner, the toner including a first component and a second component that are present separately from each other and form a color when they are reacted with each other, and a photocurable composition containing either one of the first component and the second component, the photocurable composition being cured or maintained in an uncured state by applying color forming information, to control the reaction for color formation; a color forming information applying device; a transfer device; a fixing device; and a color formation device.

7 Claims, 9 Drawing Sheets

IMAGE FORMING APPARATUS AND IMAGE FORMING METHOD

BACKGROUND

1. Technical Field

The present invention relates to an image forming apparatus and an image forming method employing an electrostatic recording method.

2. Related Art

Conventionally, in a recording apparatus which obtains a color image by an electrographic process, a color image is obtained by developing three primary colors according to respective image data, and sequentially superposing these toner images. As to a specific structure of the apparatus, there is known: a so-called four cycle apparatus which develops each color in one photoreceptor drum formed with a latent image by an image forming method, and repeats transferring the colors onto transfer members, so as to obtain a color image; or a tandem apparatus which comprises photoreceptor drums and development units per image forming device of respective colors, and sequentially and continuously transfers toner images by the movement of transfer members, so as to obtain a color image.

These are common at least in having a plurality of development units per respective colors. Therefore, in a normal color image formation, four development units for three primary colors plus black are required. Furthermore, a tandem apparatus requires four photoreceptor drums according to the respective four development units, and a device which matches the synchronization of these four image forming units. Thus, it is inevitable to increase the size and the cost of the apparatus.

SUMMARY

According to an aspect of the present invention, there is provided an image forming apparatus comprising:

an image holding member; a toner image formation device that forms a toner image on a surface of the image holding member using a toner, the toner including a first component and a second component that are present separately from each other and form a color when reacted with each other, and a photocurable composition containing either one of the first component and the second component, the photocurable composition being cured or maintained in an uncured state by applying color forming information, to control the reaction for color formation; a transfer device that transfers the toner image formed on the image holding member surface onto a recording medium surface; a color forming information applying device that applies color forming information to the toner image; a fixing device that fixes the toner image transferred onto the recording medium surface; and a color formation device that forms a color of the toner image applied with the color forming information.

BRIEF DESCRIPTION OF THE DRAWINGS

Exemplary embodiments of the present invention will be described based on the following figures, wherein:

FIGS. 5A and 5B are schematic diagrams for describing the mechanism of color formation of the toner, wherein FIG. 5A shows a color forming part and FIG. 5B shows an enlarged view thereof:

DETAILED DESCRIPTION

Hereunder is a detailed description of an aspect of the present invention.

The image forming apparatus (image forming method) of an aspect of the present invention is an image recording apparatus (image forming method) using a toner that includes a first component and a second component that are present separately from each other and form a color when reacted with each other, and a photocurable composition containing either one of the first component and the second component, the photocurable composition being cured or maintained in an uncured state by applying color forming information by means of light, to control the reaction for color formation, and the apparatus (method) includes:

an image holding member; a toner image formation device (toner image formation step) that forms a toner image on an image holding member surface; a transfer device (transfer step) that transfers the toner image formed on the image holding member surface onto a recording medium surface; a color forming information applying device (color forming information application step) that applies color forming information by means of light to the toner image; a fixing device (fixing step) that fixes the toner image transferred onto the recording medium surface, by means of heat and/or pressure; and a color formation device (color formation step) that forms a color of the toner image applied with the color forming information by heating.

First is a brief description of the toner used in an aspect of the present invention.

The toner of an aspect of the present invention includes a first component and a second component that are present separately from each other and form a color when reacted with each other, and a photocurable composition containing either one of the first component and the second component; and the photocurable composition is cured or maintains in an uncured state by applying color forming information by means of light, to control the reaction for color formation.

First is a description of the mechanism of the color formation of the toner.

As described later, the toner of an aspect of the present invention has, in a binder resin, one or more continuous regions capable of forming one specific color (or capable of maintaining a state of not forming a color), when it is applied with color forming information by means of light, called a color forming part.

Figure 5B:
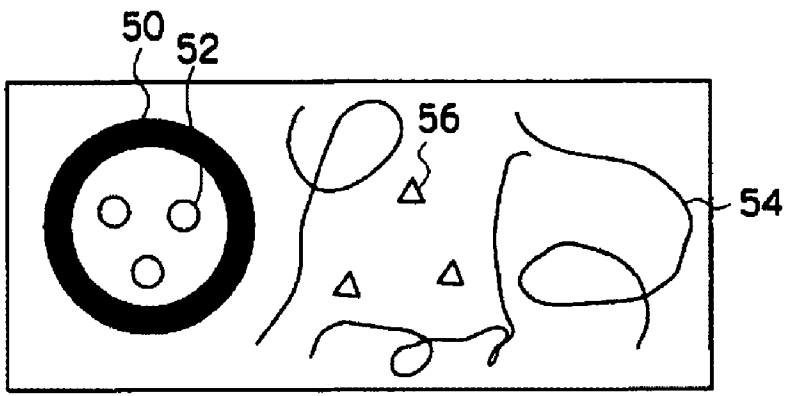
Figure 5A:
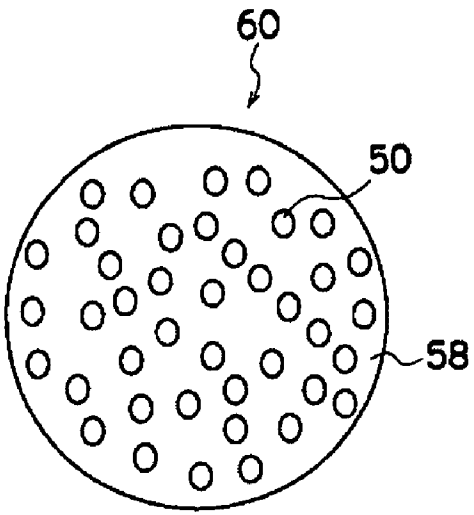

FIGS. 5A and 5B are schematic diagrams showing an example of the color forming part in the toner, wherein FIG. 5A is a cross-sectional view of one color forming part and FIG. 5B is an enlarged view of the color forming part.

As shown in FIG. 5A, the color forming part 60 includes color forming microcapsules 50 containing color formers of respective colors, and a composition 58 surrounding them. As shown in FIG. 5B, the composition 58 contains a photopolymerization initiator 56 and a developer monomer (second component) 54 having a polymerizable functional group which forms a color by being adjacent or in contact with a color former (first component) 52 contained in the microcapsule 50.

In the color forming part 60 of the toner particle, a color former 52 enclosed in the color forming microcapsule 50 is suitably a triaryl leuco compound or the like which is superior in vividness of hue of the formed color. The developer monomer 54 which forms a color of this leuco compound (electron donating) may be an electron accepting compound. In particular, it is typically a phenolic compound and may be appropriately selected from developers used for thermo/pressure sensitive papers. By an acid-base reaction between such electron donating color former 52 and electron accepting developer monomer 54, the color former forms a color.

As to the photopolymerization initiator 56, there is used a spectral sensitizing dye which is sensitive to visible light, and generates polymerizable radicals serving as a trigger for polymerizing the developer monomer 54. For example, a reaction accelerator for the photopolymerization initiator 56 is used so as to proceed a sufficient polymerization reaction of the developer monomer 54 with respect to light exposure of three primary colors such as R, G, and B. For example, by using an ion complex including a spectral sensitizing dye (cation) which absorbs exposed light, and a boron compound (anion), then the spectral sensitizing dye is photoexcited by light exposure and electrons are moved to the boron compound, and thereby polymerizable radicals are generated to start polymerization.

By combining these materials, a color formation and recording sensitivity of about 0.1 to 0.2 $mJ/cm^2$ may be obtained as a photosensitive color forming part 60.

Depending on the presence/absence of light irradiation for color forming information with respect to the color forming part 60 of the above structure, some color forming parts 60 have the polymerized developer compounds and the others have unpolymerized developer monomers 54. By a subsequent color formation step involving heating or the like, in the color forming part 60 having unpolymerized developer monomers 54, heat or the like makes these developer monomers 54 migrate, pass through holes in the wall of the color former microcapsule 50, and be dispersed in the color former microcapsule. Regarding the developer monomers 54 and the color formers 52 dispersed in the microcapsule 50, since the color former 52 is basic and the developer monomer 54 is acidic as described above, the color former 52 forms a color by acid-base reaction.

On the other hand, in the following color formation step involving heating or the like, the polymerized developer compounds can not pass through holes in the wall of the color former microcapsule 50, and can not be dispersed therein, due to the bulkiness caused by the polymerization. Therefore, they can not be reacted with the color former 52 in the color forming microcapsule, and are unable to form a color. Consequently, the color forming microcapsule 50 is left uncolored. That is, the color forming part 60 irradiated with light of a specific wavelength is present without forming a color.

After the color formation, by exposing the whole surface to light again by a white light source at an appropriate stage, the remaining unpolymerized developer monomers 54 may be all polymerized and an image may be stably fixed. Moreover, by decomposing the remaining spectral sensitizing dye, the ground color is decolored. The spectral sensitizing dye of the photopolymerization initiator 56 corresponding to the visible light region has its tone remaining as the ground color to the end. However, the photodecoloration phenomenon of the color/boron compound can be utilized for decoloration of this spectral sensitizing dye. That is, polymerizable radicals are generated by electron movement from the photo excited spectral sensitizing dye to the boron compound. The radicals cause polymerization of monomers while causing color decomposition of the dye by reacting with excited dye radicals, resulting in decoloration of the dye.

In the toner of an aspect of the present invention, the color forming parts 60 which form different colors in such a manner (for example, form colors of Y, M, and C) include microcapsules in a condition where the respective developer monomers 54 do not interfere with color formers except for their target color formers 52 (a condition where they are separated from each other), to be used.

In this manner, in an aspect of the present invention, a toner containing microcapsules which integrally have color formers 52 forming multiple different colors, is applied to a single development unit, so as to obtain a color image by applying electrophotography.

In the image forming apparatus (image forming method) of an aspect of the present invention, such a toner is installed in one developing device, and an electrostatic latent image is formed on an image holding member by a logical OR operation of image formation data of four colors of cyan (C), magenta (M), yellow (Y), and black (K). The electrostatic latent image is developed by the toner to make a toner image. Thereafter, for example, the toner image is exposed to light of a wavelength corresponding to the color forming information, to apply the toner image with the color forming information. Then, the toner image applied with the color forming information is transferred onto a recording medium, and fixed to the recording medium by heat and pressure thereafter. At this time, color formation reaction of the toner is performed and the color image is obtained.

Consequently, since a full color image may be obtained with one image holding member and one developing device, the size of the image forming apparatus main body may be infinitely closer to the size of a black and white printer, and the apparatus may be miniaturized. In addition, since there is no need of laminating toners for each color when forming a toner image, irregularity on the image surface may be suppressed and the image surface may be made evenly glossy. Furthermore, since a colorant such as a pigment is not used for the toner, a silver salt like image may be also obtained.

Moreover, as described later, in the toner of an aspect of the present invention, since the color forming information application mechanism with respect to the toner is not a reversible reaction, the toner that is desired to form a color for highlight image formation, may stably form a color at a low to half tone density. Consequently, high-quality images may be formed as seen in a current multicolor inkjet printer. Furthermore, as described above, since the color forming information application mechanism is not a reversible reaction, there is a merit of not having a restriction of time from heating to color formation, resulting in merits of being able to print down to low speed regions, that is, being able to correspond to a wide speed range, and in addition, having a high degree of freedom regarding the arrangement position of the fixing unit which performs color formation by heating.

The image formation process applied with an aspect of the present invention is not specifically limited and may be: a so-called an electrophotographic process; a process (ionography) for forming an electrostatic latent image with ions or the like on a dielectric substance; a process for forming an electrostatic latent image according to image data on an evenly charged dielectric substance by heat of a thermal head; a process for not using an electrostatic latent image, but forming for example a magnetic latent image so as to form a toner image; and a process for forming cohesive ink droplets according to image data, on an image holding member, to form a toner image. First is a brief description of an image forming apparatus (image forming method) applied in an aspect of the present invention, which forms a color image by an electrophotographic process using a toner capable of controlling a color formation or non color formation state according to color forming information by means of light.

Details of components of the toner to be used are described later.

Figure 1:
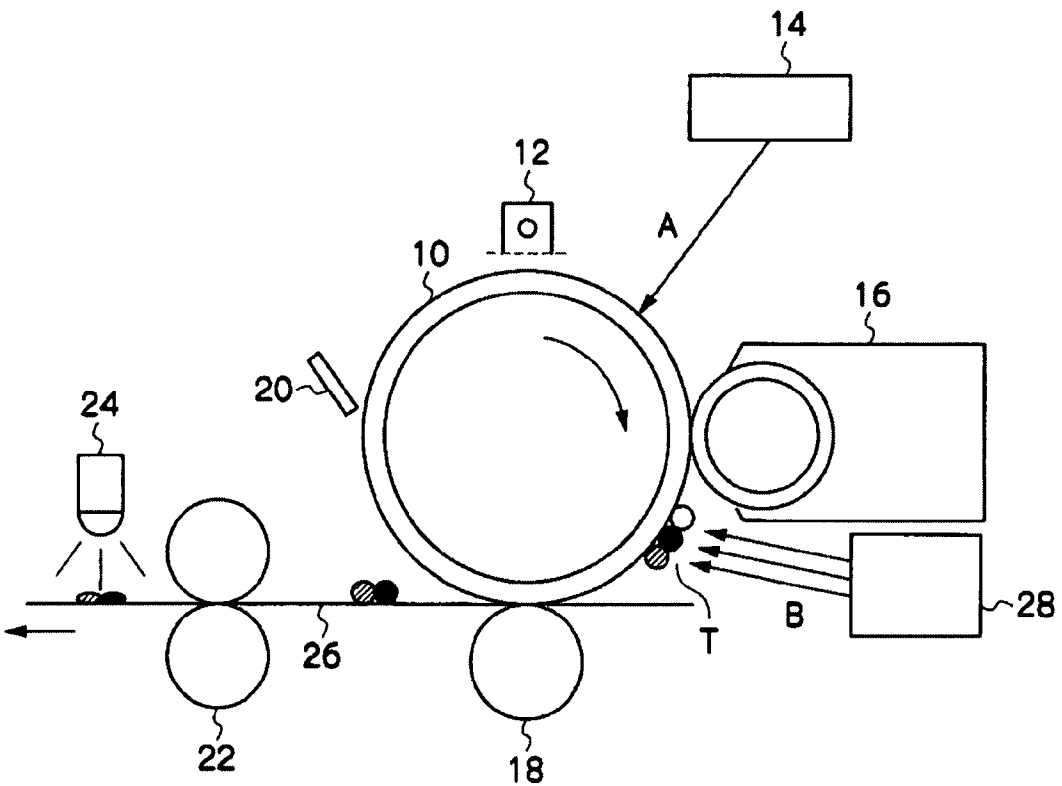
FIG. 1 is a schematic block diagram showing an example of an image forming apparatus of an aspect of the present invention.

FIG. 1 is a schematic block diagram showing an example of the image forming apparatus of an aspect of the present invention. The image forming apparatus shown in FIG. 1 has a photoreceptor (image holding member) 10, a charging unit (charging device) 12, an exposure unit (exposure device) 14, a development unit (development device) 16, a transfer unit (transfer device) 18, and a fixing unit (fixing device) 22 used in a normal electrophotographic process. Moreover, the present apparatus is provided with a color forming information applying unit 28 which applies a developed toner image with color forming information, and the fixing unit 22 also functions as a color formation unit (color formation device) which forms a color of the toner image. Furthermore, on the downstream side of the fixing unit 22 is provided a photo irradiation unit 24 (photo irradiation device) which irradiates light onto a recording medium 26 for fixing the color formation of the toner. Reference symbol 20 denotes a cleaner.

Hereunder is a description of a structure of the image forming apparatus of an aspect of the present invention along with respective steps in image formation.

<Toner Image Formation Step>

If the image holding member is the photoreceptor 10 as shown in FIG. 1, the toner image formation device includes the charging unit 12 which charges the photoreceptor surface, the exposure unit 14 which forms an electrostatic latent image on the photoreceptor surface by light exposure, and the development unit 16 which makes the electrostatic latent image into a toner image by a developing agent containing the toner.

Firstly, the whole surface of the photoreceptor 10 is charged by the charging unit 12.

As to the photoreceptor 10, any publicly known photoreceptor may be used. For example, it may be an inorganic photosensitive layer such as Se and a-Si, or a single layer or multilayer of organic photosensitive layer, formed on a conductive substrate. In the case of a belt-like photoreceptor, a transparent resin such as PET and PC may be used as a substrate. The thickness is determined from design items such as the diameter and the tension of a roll bridging the belt-like photoreceptor, and is within a range between about 10 to 500 μm. The other layer structure and the like are similar to the case of the drum.

In the color forming information application step described later, if light is exposed from the backface of the photoreceptor 10 (inside of the photoreceptor), a transparent photoreceptor using a transparent resin as the substrate may be used. In the case of the transparent photoreceptor, a transparent material with respect to exposed light is used as a photoreceptor substrate. For example, a glass or a plastic material is used as a material for the substrate, and the outer surface is formed with a conductive layer for forming an electrode. However, the substrate material itself may be conduction treated. If the transparent photoreceptor is not used, normally used substrate materials such as a metal cylindrical body of aluminum, and a nickel seamless belt may be used besides the above-mentioned transparent substrate.

Moreover, since much stronger light is exposed for applying the color forming information described later than light for forming a normal latent image (light energy required for supplying for the color forming information application is about 1000 times the light exposure (2 $mJ/m^2$) of the photoreceptor used for a normal electrophotographic process), then damage to the photoreceptor 10 is of concern. However, by setting the photosensitivity of the charge generating layer of the photoreceptor 10 to 1/1000 of the conventional case, balance is maintained and there is no problem.

Furthermore, the surface of the photoreceptor 10 may have a function for preventing degradation of the photoreceptor 10 due to light exposure for applying the color forming information. Specifically, it is effective to provide a surface layer which allows only exposure light for forming a latent image on the surface of the photosensitive layer to permeate but reflects or absorbs exposure light for applying the color forming information. The surface layer includes a dichroic mirror coat (reflection) and a sharp cut filter (absorption) in which a photoabsorptive substance is dispersed.

A publicly known charging device may be used for charging. In a contact method, a roll, a brush, a magnetic brush, a blade, and the like may be used. In a non contact method, a corotron, a scorotron, and the like may be used. As the charging device, it is not limited to these.

Among these, a contact type charger is preferably used from the balance of the charging compensation capability and the ozone generation amount. The contact charging method is to charge the photoreceptor surface by applying a voltage to a conductive member which is made in contact with the photoreceptor surface. The shape of the conductive member may be any shape such as a brush shape, a blade shape, a pin electrode shape, and a roll shape. However, a roll shaped member is particularly preferred. Normally, the roll shaped member comprises, from the outside, a resistive layer, an elastic layer supporting it, and a core. Furthermore, as required, a protective layer may be provided on the outside of the resistive layer.

In the method of charging the photoreceptor 10 using these conductive members, a voltage is applied to the conductive members but the applied voltage may be a DC voltage or a DC voltage superimposed with an AC voltage. If charging is performed only with a DC voltage, the voltage may be either positive or negative of a desired surface potential of +500 V in the absolute value, whose value is 700 V to 1500 V. If an AC voltage is superimposed, the DC value is about a desired surface potential of ±50 V, where the voltage between AC peaks (Vpp) may be 400 to 1800 V and preferably 800 to 1600 V, the frequency of the AC voltage may be 50 to 20000 Hz and preferably 100 to 5000 Hz, and any waves such as sine waves, square waves, and triangular waves may be used.

The charging potential may be set within a range between 150 and 700 V in the absolute value of potential.

A publicly known exposure unit 14 may be used for forming an electrostatic latent image. As to the exposure unit 14, for example there may be used a laser scanning system, an LED image bar system, an analog exposure device, and an ionic current control head. As shown by the arrow A in FIG. 1, light may be exposed onto the surface of the photoreceptor 10. In addition, a new exposure device which will be developed in the future may be used as long as the effect of an aspect of the present invention is achieved.

The wavelength of the light source to be used is within a spectral sensitivity window of the photoreceptor 10. Up to now, near infrared having an emission wavelength around 780 nm is the mainstream as a wavelength of a semiconductor laser. However, there may be used a laser having an emission wavelength of 600 nm or more but less than 700 nm, and a laser having an emission wavelength around 400 to 450 nm as a blue laser. Moreover, in order to form a color image, a plane emission type laser light source capable of outputting multi-beams is also effective.

Light exposure onto the photoreceptor 10 is performed in the position where a toner is developed described later, in the case of reversal development, and in the position where a toner is not developed, in the case of positive development, as a logical OR operation of the image formation data of the four colors. The spot diameter of exposed light may be within a range between 40 to 80 μm so that the definition becomes within a range between 600 and 1200 dpi. The amount of light exposure may be set so that the potential after light exposure is within a range between about 5 and 30% of the charging potential. However, if the development amount of the toner is changed according to the gradation of the image, the amount of light exposure may be changed according to the development amount for each position of light exposure.

A publicly known development unit 16 may be used for the development onto the electrostatic latent image. As to the development method, there may be used a two component development method in which a developing agent including a toner and micromagnetic particles called carriers for supporting the toner is used, a one component development method in which a developing agent including a toner only is used, and both such development methods having another components added for improving development or other properties.

Moreover, depending on the development method, there may be used a method for developing the photoreceptor 10 in contact or not in contact with a developing agent, and a combination thereof. Furthermore, there may be used a hybrid development method that is a combination of the one component development method and the two component development method. In addition to this, a new development device which will be developed in the future may be used as long as the effect of an aspect of the present invention is achieved.

The toner contained in the developing agent may be such that, for example one toner particle contains a color forming part (Y color forming part) capable of forming Y color, a color forming part (M color forming part) capable of forming M color, and a color forming part (C color forming part) capable of forming C color, or the toners respectively contain the Y color forming part, the M color forming part, and the C color forming part separately.

The toner development amount (amount of toner adhered onto the photoreceptor) differs according to the image to be formed, however is preferably within a range between 3.5 and 8.0 g/m$^2$, and more preferably within a range between 4.0 and 6.0 g/m$^2$.

Moreover, in the formed toner image T, light for applying the color forming information described later has to be spread all over the irradiated part. Therefore the toner layer thickness may be controlled to under a fixed amount. Specifically, for example in a solid image, the number of toner layers is preferably three or less and more preferably two or less. The toner layer thickness is a value obtained by measuring the actual thickness of the toner layer(s) formed on the surface of the photoreceptor 10 and then dividing this by the number average particle diameter of the toner.

<Color Formation Data Application Step>

Next, as shown in FIG. 1, the toner image T obtained in such a manner is applied with color forming information by means of light such as shown by arrow B by the color forming information applying unit 28. Here, "application of color forming information by means of light" means to selectively apply one or more types of light of a specific wavelength to a desired area in the toner image, or not to apply any light, so as to control the color formation/non color formation state, and the tone if forming a color, per each unit of toner particle constituting the toner image T.

The position of the color forming information application step shown in FIG. 1 is one example, and the color forming information application step may be after the transfer step as described later.

As to the color forming information applying unit 28, any unit may be used as long as it can irradiate light of a wavelength that enables the toner particle to form a specific color at that time, with predetermined definition and intensity. For example, an LED image bar and a laser ROS may be used. The spot diameter of light to be irradiated on the toner image T is preferably adjusted within a range between 10 and 300 μm so that the definition of the image to be formed is within a range between 100 and 2400 dpi, and more preferably within a range between 20 and 200 μm.

The wavelength of light supplied to form a color or to maintain the state of not forming a color is determined according to the design of the toner material to be used. For example, if a toner (photo-induced color forming toner) which forms a color by irradiation of light having a specific wavelength is used, light of 405 nm ($\lambda_A$ light) for forming yellow (Y color), light of 535 nm ($\lambda_B$ light) for forming magenta (M color), and light of 657 nm ($\lambda_C$ light) for forming cyan (C color) are respectively irradiated onto desired positions to form the colors.

Moreover, in order to form a secondary color, a combination of the light may be used, and $\lambda_A$ light and $\lambda_B$ light for forming red (R color), $\lambda_A$ light and $\lambda_C$ light for forming green (G color), and $\lambda_B$ light and $\lambda_C$ light for forming blue (B color) are respectively irradiated onto desired positions to form the colors. Furthermore, in order to form black (K color) serving as a tertiary color, the $\lambda_A$ light, $\lambda_B$ light, and $\lambda_C$ light are accumulatedly irradiated on a desired position to form p the color.

On the other hand, in the case of a toner (non photo-induced color forming toner) which maintains the state of not forming a color by irradiation of light of a specific wavelength, then for example, light of 405 nm ($\lambda_A$ light) for not forming yellow (Y color), light of 535 nm ($\lambda_B$ light) for not forming magenta (M color), and light of 657 nm ($\lambda_C$ light) for not forming cyan (C color) are respectively irradiated onto desired positions to form the colors. Therefore, $\lambda_B$ light and $\lambda_C$ light for forming Y color, $\lambda_A$ light and $\lambda_C$ light for forming M color, and $\lambda_A$ light and $\lambda_B$ light for forming C color are respectively irradiated onto desired positions to form the colors.

Moreover, in order to form a secondary color, a combination of the light may be used, and $\lambda_C$ light for forming red (R color), $\lambda_B$ light for forming green (G color), and $\lambda_A$ light for forming blue (B color) are respectively irradiated onto desired positions to form the colors. Furthermore, in order to form black (K color) serving as a tertiary color, no light is exposed to a desired position to form the color.

A publicly known image modulation method such as pulse width modulation, intensity modulation, and a combination thereof may be used as required for light from the color forming information applying unit 28. Moreover, the amount of light exposure is preferably set within a range between 0.05 and 0.8 mJ/cm$^2$ and more preferably within a range between 0.1 and 0.6 mJ/cm$^2$. Particularly, regarding this amount of light exposure, the required amount of light exposure correlates with the amount of the developed toner. For example, with respect to about 5.5 g/m$^2$ of toner formation amount (solid), light exposure within a range between 0.2 and 0.4 mJ/m$^2$ may be performed.

In the structure of the apparatus shown in FIG. 1, since the color forming information is applied only from one side of the photoreceptor 10, light for color formation delivered to the bottom layer part of the toner developed in multi layers may be limited, and sufficient color formation can not be obtained, resulting in that the color in the image may differ from the desired one. Therefore, in an aspect of the present invention, the photoreceptor 10 may be provided with a reflection device which reflects the exposed light for applying the color forming information to the toner image formed on the photoreceptor 10.

Figure 2:
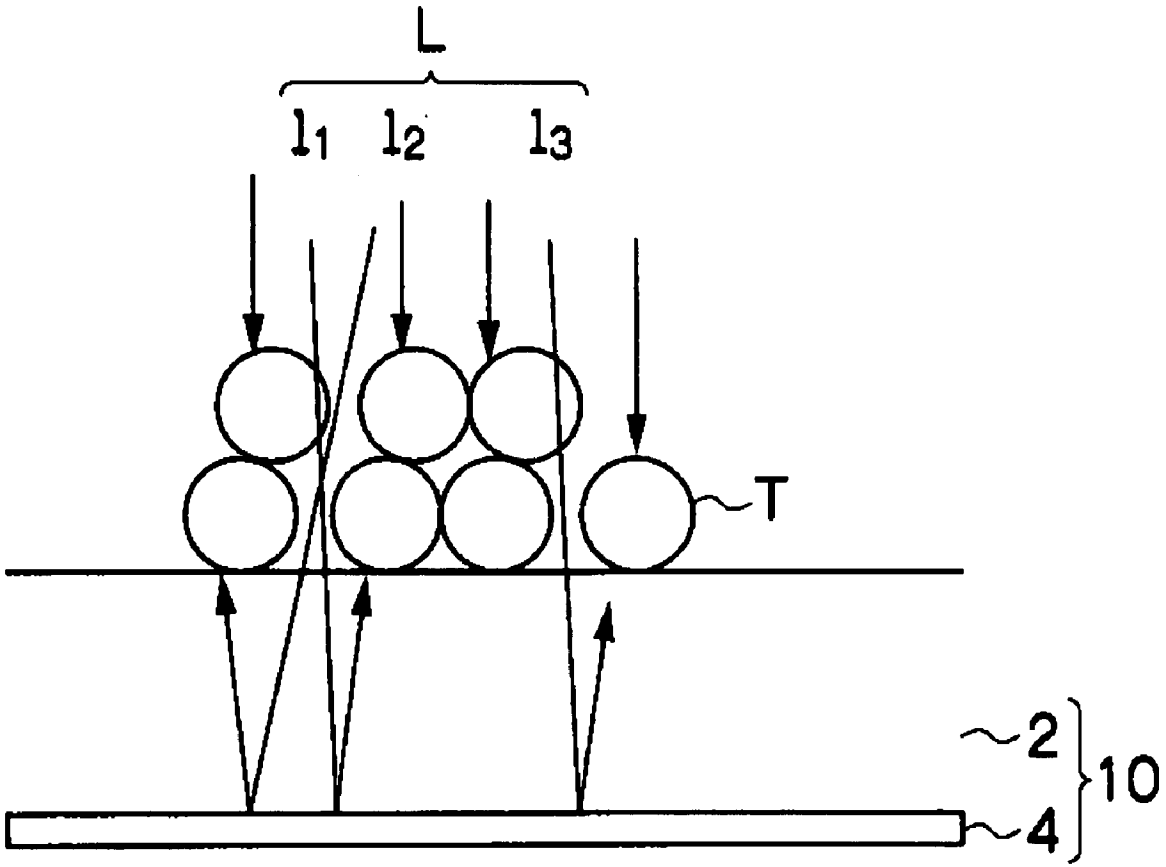
FIG. 2 is a schematic cross-sectional view showing a state where light for applying color forming information is exposed to a toner image.

FIG. 2 shows a cross-section of the photoreceptor 10 retaining the toner image when light for applying the color forming information is exposed. When the toner image (toner layer) T formed on the photoreceptor 10 is exposed to light for applying the color formation data (arrow L in the drawing), about 10 to 50% of light goes through the toner itself or gaps between the toner layers, and reaches the photoreceptor 10. Therefore, as shown by $l_1$ to $l_3$ in the drawing, if the light that has reached there is reflected by the reflection device 4 and the toner is exposed to light again, then the toner image T developed in multi layers may be exposed to light from the bottom layer side in the drawing, and the toner may be sufficiently exposed to light for applying the color forming information, resulting in that sufficient color formation may be obtained and the color in the image may be made the desired one. Numeral 2 denotes a photosensitive layer.

As to the reflection device 4 which reflects the exposed light, the photosensitive layer itself in the photoreceptor 10 may have the function thereof, or the substrate of the photoreceptor 10 may have the function. In the former case, as an example of the photosensitive layer having the reflection device, a surface layer provided on the surface of the photosensitive layer is used as a mirror face, and a dichroic mirror coat or the like may be used as the surface layer. Moreover, in the latter case, in order to use the substrate itself as the reflection device, the surface of the substrate may be smoothened (12.5 μm or less in arithmetical average roughness Ra described in JIS B 0601).

The reflectivity of the exposed light if the reflection device is provided is preferably 80% or more, and more preferably 90% or more.

If the exposed light at this time is a laser beam, the laser beam incident onto the photoreceptor is normally required to be incident at several degrees (4 to 13 degrees) in order to prevent the laser beam from returning to a monitor (Photo Detector). However, in light exposure for applying the color forming information in an aspect of the present invention, since the returned beams are absorbed into the toner, the returned beams are extremely reduced, enabling an incidence at an optional angle including 0 degrees.

Moreover, regarding the above, the color forming information applying unit 28 may be arranged in a box body having the exposure unit 14 for forming the latent image. By so doing, the exposure device including an optical system can be partially made common or simplified, enabling to further miniaturize the whole apparatus.

Hereunder is a brief description of the timing and the positional control for the light exposure for applying the color forming information.

Figure 3:
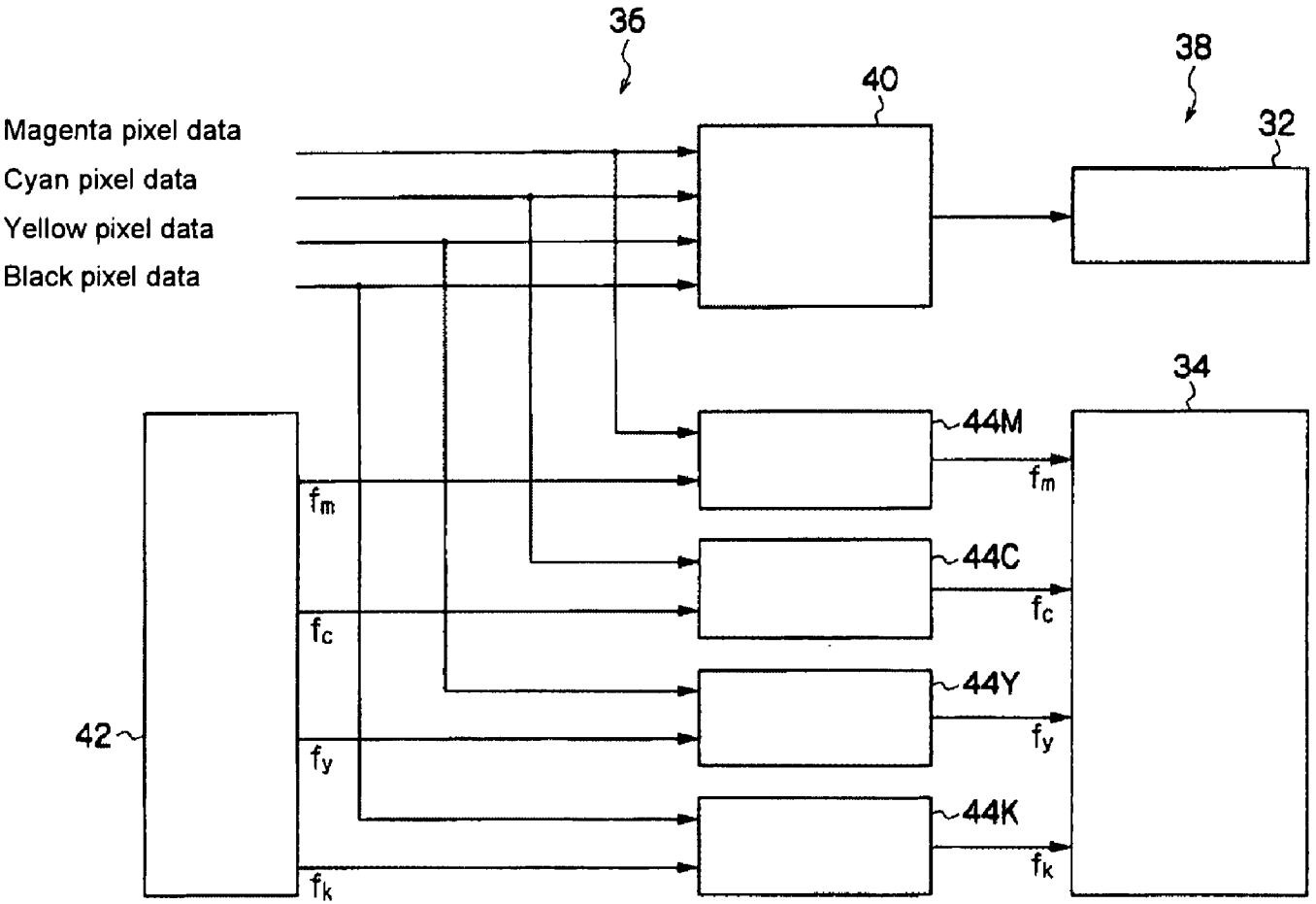
FIG. 3 is a circuit block diagram of a print control unit.

FIG. 3 is a specific circuit block diagram of a print control unit in the image forming apparatus of an aspect of the present invention. In the diagram, a printer controller 36 includes a logical OR circuit 40, an oscillation circuit 42, a magenta color formation controlling circuit 44M, a cyan color formation controlling circuit 44C, a yellow color formation controlling circuit 44Y, and a black color formation controlling circuit 44K. On the other hand, an exposure unit 38 includes a photo write head 32 and a color forming information applying light exposure head 34.

Image data which is an input RGB signal converted into a CMYK value by an interface (I/F) (not shown), is further output from the interface (I/F) to the logical OR circuit 40 as pixel data of magenta (M), cyan (C), yellow (Y), and black (K). Here, the logical OR circuit 40 calculates the logical OR operation of CMYK and outputs it to the photo write head 32.

That is, the logical OR operation data including all CMYK pixel data is output to the photo write head 32, and photo writing is performed onto the photoreceptor 10 as described above. Consequently, on the circumferential face of the photoreceptor 10 is formed an electrostatic latent image based on the logical OR operation data including all CMYK pixel data.

Moreover, the CMYK pixel data is also supplied to the corresponding circuits of the magenta color formation controlling circuit 44M through to the black color formation controlling circuit 44K, and output to the color forming information applying light exposure head 34 synchronously with oscillation signals fin, fc, fy, and fk which are output from the oscillation circuit 42. That is, the color forming information corresponding to respective magenta (M), cyan (C), yellow (Y), and black (K) is supplied to the color forming information applying light exposure head 34, and light of a specific wavelength for forming a color or for maintaining the state of not forming a color is irradiated corresponding to the toner image T developed on the photoreceptor 10. Consequently, in the toner receiving the irradiated light, a photo curing reaction described later occurs and the color forming information is applied.

For example, a color formation signal fm output from the magenta color formation controlling circuit 44M irradiates the $\lambda_B$ light onto the color forming part in the toner, so that the toner is capable of forming magenta (M) color. Moreover, a color formation signal fc output from the cyan color formation controlling circuit 44C irradiates the $\lambda_C$ light onto the color forming part in the toner, so that the toner is capable of forming cyan (C) color. Furthermore, yellow (Y) and black (K) are similar to the above, and a color formation signal fy or fk output from the yellow color formation controlling circuit 44Y or the black color formation controlling circuit 44K irradiates the $\lambda_A$ light, or the $\lambda_A$ light, the $\lambda_B$ light and $\lambda_C$ light onto the color forming part in the toner, so that the toner is capable of forming yellow (Y) or black (K) color.

Regarding the color forming information application step (device) of an aspect of the present invention, the mechanism for forming a full color image is described above. However, the color forming information application step of an aspect of the present invention may be for forming a mono color image which forms any one of yellow, magenta, and cyan. In this case, from the color forming information applying exposure head 54, only light of a specific wavelength corresponding to a desired color formation among yellow, magenta, and cyan is irradiated. The other preferable conditions are similar to conditions for forming a full color image. Moreover, the toner image holding member may be transparent and the color forming information may be applied from the back face.

In the image forming apparatus shown in FIG. 1, the color forming information application step is performed after the development but before the transfer. However, the color forming information application step of an aspect of the present invention may be at least before the fixing step. For example, the color forming information application step may be after the transfer step described later. However, the color forming information application step may be, from the point of the smoothness of the recording medium surface and the accuracy of the color formation position on a desired image, performed after the development step but before the transfer step for image quality.

In this stage, the toner image still remains the original tone before forming a color, and if a dye is sensitized, the toner image only bears the tone of the dye.

<Transfer Step>

The toner applied with the color forming information is then transferred onto the recording medium 26 altogether. A publicly known transfer unit 18 may be used for transfer. For example, in a contact method, a roll, a brush, a blade, and the like may be used. In a non contact method, a corotron, a scorotron, a pin scorotron, and the like may be used. Moreover, transfer by means of pressure, or pressure and heat is also possible.

The transfer bias may be within a range between 300 and 1000 V (absolute value), and AC (Vpp: 400 V to 4 kV, 400 to 3 kHz) may be further superimposed thereon.

<Fixing Step and Color Formation Step>

Regarding the toner image set in a state capable of forming a color (or maintaining a state of not forming a color) in this manner, the recording medium 26 is heated by the fixing unit 22, and thereby the color is formed as described above. A publicly known fixing device may be used as the fixing unit 22. For example, a roll or a belt may be respectively selected as a heating member or a pressurizing member. A halogen lamp, an IH, and the like may be used as a heat source. The arrangement may correspond to various paper passes such as a straight pass, a rear C pass, a front C pass, an S pass, and a side C pass.

Figure 4:
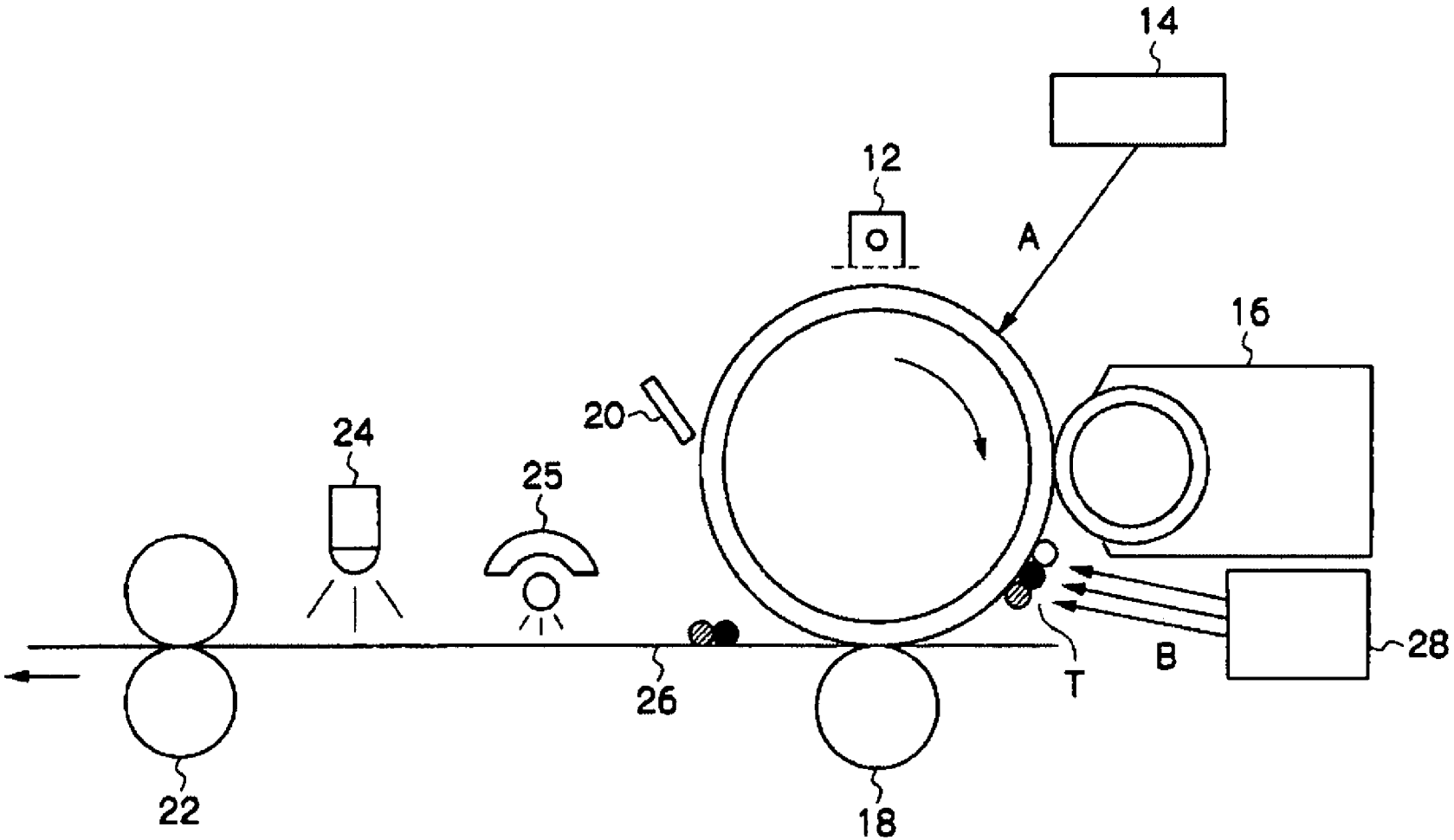
FIG. 4 is a schematic block diagram showing another example of the image forming apparatus of an aspect of the present invention.

In the present embodiment, the fixing unit 22 performs both the color formation step and the fixing step, however the color formation step and the fixing step may be separately provided. The position for arranging the color formation unit for performing the color formation step is not specifically limited. For example, as shown in FIG. 4, the color formation unit 25 and the photo irradiation unit 24 may be provided on the upstream side of the fixing unit 22. By so doing, since the heating temperature for forming a color and the heating temperature for fixing the toner onto the recording medium 26 can be controlled separately, the degree of freedom in the design of the color formation material, the toner binder material, and the like may be improved. The other reference symbols in FIG. 4 denote the same parts as those in FIG. 1.

In this case, regarding the method of color formation, various methods may be considered according to the color formation mechanism of the toner particle. Therefore, as to the color formation unit (color formation device) 25, for example, there may be used a light emission device of a specific light in a method of controlling or forming a color by a method such as photo decomposition or curing of color formation related substances in the toner using light of a more different wavelength, or a pressurizing device in a method of controlling or forming a color by a method of pressurizing to break the encapsulated color formation particles.

However, since such chemical reactions for color formation are generally slow in the reaction speed due to migration or dispersion, sufficient diffusion energy needs to be applied in any above method. In this point, the method of heating to accelerate the reaction can be said to be superior. As a result, it is preferable to use the fixing unit 22 which performs both the color formation step and the fixing step, from the point of miniaturization.

<Other Steps>

An aspect of the present invention preferably includes a photo irradiation step which irradiates light onto an image obtained through the fixing and the color formation step. By so doing, since the reactive substances remaining in the color forming part which has been controlled in the state of not forming a color may be decomposed or deactivated, the change of the color balance after image formation may be reliably suppressed and the background color bay be removed/bleached.

In the present embodiment, the photo irradiation step is provided after the fixing step. However, in the case of a fixing method without heat melting, such as pressure fixing by fixing using pressure, the fixing step may be also performed after the photo irradiation step.

The photo irradiation unit 24 is not specifically limited provided that the toner can be prevented from further forming a color, and there may be used a publicly known lamp, such as a fluorescent lamp, an LED, and an EL. Moreover, the wavelength may include three wavelengths for forming colors in the toner, the illuminance may be within a range between about 2000 and 200000 lux, and the exposure time may be within a range between 0.5 and 60 secs.

In addition, the above image forming method may include a publicly known step used for an electrophotographic process performed using a colorant such as an already known pigment. For example, it may include a cleaning step for cleaning the image holding member surface after the toner image is transferred. A publicly known cleaner may be used as the cleaner 20, and a blade, a brush, and the like may be used. Moreover, a so-called cleanerless process without the cleaner 20 is also applicable.

Moreover, in addition, the transfer step may be an intermediate transfer method including a first transfer step for transferring the toner image from the image holding member to an intermediate transfer body such as an intermediate transfer belt, and a second transfer step for transferring the toner image that has been transferred to the intermediate transfer body, onto a recording medium.

As described above, in the image forming apparatus of an aspect of the present invention, since the color forming information is stably retained in the toner from the color forming information application step when the color forming information is applied to the color formation step, there is no need to consider the time from the color forming information application step to the color formation step, and it is possible to correspond to a design with a wide speed range. Specifically, the linear velocity is preferably set within a range between 10 and 500 mm/second, and more preferably within a range between 50 and 300 mm/second. Even if an image is formed with such a linear velocity, the exposure time for applying the color forming information may be set to a value determined from the linear velocity and the definition.

Moreover, the stable retention of the color forming information has a superior effect for the tone stability in the image and the reproducibility of the highlight image, therefore contributing to a full color image formation capable of reproducing the input image data finely with a high image quality.

<Toner to be Used>

Next is a description of a structure of the toner to be used for an aspect of the present invention.

As described above, the toner of an aspect of the present invention has a first component and a second component that are present separately from each other and form a color when they are reacted with each other, and a photocurable composition containing either one of the first component and the second component; and cures the photocurable composition or maintains an uncured state by applying color forming information by means of light, to control the reaction for color formation. The mechanism of the color formation of the toner is described as above.

The toner of an aspect of the present invention contains a first component and a second component that are present separately from each other and form a color when they are reacted with each other, as a substance capable of forming a color (color forming substance). In this manner, by forming a color using the reaction of two types of reactive components, the color formation may be readily controlled. The first component and the second component may be previously colored before the color formation, however it is preferably a substantially non-color substance.

In an aspect of the present invention, in order to readily control the color formation, there are used two types of reactive components which form a color when they are reacted with each other, as a color forming substance. However, if these reactive components are present in the same matrix where the substances are easily diffused, in a state where the color forming information by means of light is not applied, coloration may be spontaneously accelerated during the preservation or production of the toner.

As a result, the reactive components need to be contained by each type in different matrixes where the substances are hardly diffused to other regions (separated from each other) unless the color forming information by means of light is applied.

In this manner, in order to prevent the substances from being diffused in the state where the color forming information by means of light is not applied, so as to prevent the spontaneous coloration during the preservation or production of the toner, the first component of the two types of the reactive components may be contained in a first matrix and the second component may be contained outside of the first matrix (second matrix), and a wall may be provided between the first matrix and the second matrix having a function of preventing the substances from being diffused between the two matrixes but enabling the substances to be diffused between both matrixes when an external stimulation such as heat is applied, according to the type, the strength, and the combination of the stimulation.

In order to arrange two types of reactive components in the toner using such a wall, microcapsules may be used.

In this case, in the toner of an aspect of the present invention, among the two types of the reactive components, for example the first component may be contained in the first matrix and the second component may be contained outside of the first matrix. In this case, the inside of the microcapsule corresponds to the first matrix, and the outside of the microcapsule corresponds to the second matrix.

This microcapsule has a core and a shell coating the core, and is not specifically limited as long as it has a function of preventing the substances from being diffused through the inside and outside of the microcapsule unless an external stimulation such as heat is applied, but enabling the substances to be diffused through the inside and outside of the microcapsule when an external stimulation is applied, according to the type, the strength, and the combination of the stimulation. The core contains at least one of the reactive components.

Moreover, the microcapsule may enable the substances to be diffused through the inside and outside of the microcapsule by applying an external stimulation such as photo irradiation or pressure. However, it is particularly preferably a heat responsive microcapsule which enables the substances to be diffused through the inside and outside of the microcapsule (increases the substance permeability through the shell) by means of heat treatment.

The substance diffusion through the inside and outside of the microcapsule when a stimulation is applied may be irreversible, from the viewpoint of suppressing the reduction of color density at the time of image formation, and suppressing the change of the color balance of the image left under a high temperature environment. Therefore, the shell of the microcapsule may have a function of irreversibly increasing the substance permeability by softening, decomposition, dissolution (compatibility into a surrounding member), deformation, and the like, by applying a stimulation such as heat treatment and photo irradiation.

Next is a description of a structure where the toner contains microcapsules.

Such a toner may contain a first component and a second component that form a color when they are reacted with each other, microcapsules, and a photocurable composition having the second component dispersed therein. Such a toner includes three aspects below.

That is, in the toner of an aspect of the present invention having a first component and a second component that are present separately from each other and form a color when they are reacted with each other, and a photocurable composition containing either one of the first component and the second component, if in addition microcapsules are used, then the toner may be any one of the following three aspects: an aspect (1) (hereunder, also called a "first aspect") containing microcapsules dispersed in the photocurable composition, and having the first component contained in the microcapsule and the second component contained in the photocurable composition; an aspect (2) (hereunder, also called a "second aspect") having the second component contained in the microcapsule and the first component contained in the photocurable composition; and an aspect (3) (hereunder, also called a "third aspect") having both of the first component and the second component respectively contained in microcapsules, and the photocurable composition contained in either one of the microcapsules containing the first component or the second component.

Among these three aspects, the first aspect is particularly preferred from the viewpoint of the stability before application of the color forming information by means of light, control of color formation, and the like. In the following description of the toner, basically the toner of the first aspect is provided for detailed description. However, the structure, material, production method, and the like of the toner of the first aspect described below are of course usable/reemployable for the toner of the second aspect or the third aspect.

(Microcapsule)

The microcapsule may be a heat responsive microcapsule which enables the substances to be diffused through the inside and outside of the microcapsule by heat treatment. In this case, if the photocurable composition is cured by irradiation of color forming information applying light, then as to the external stimulation, there may be used a combination including the presence/absence of irradiation of color forming information applying light (application of controlling stimulation) and heat treatment (application of color forming stimulation).

That is, in this case, preferably, the external stimulation applied for controlling the reaction between the first component and the second component (control of the color formation reaction) contains: a color forming stimulation which brings a reaction between the first component and the second component (color formation reaction) that are in a state capable of reaction; and a controlling stimulation which controls the reaction between the first component and the second component (color formation reaction) before applying this color forming stimulation, into a state capable/incapable of color formation when the color forming stimulation is applied, wherein irradiation of color forming information applying light is used as the controlling stimulation, and a heat treatment is used as the color forming stimulation.

The heat responsive microcapsule (hereunder, also simply called "microcapsule") includes a core containing the first component and a shell coating this core. The material constituting the shell may be made from a heat responsive material which enables the substances to be diffused through the inside and outside of the microcapsule by heat treatment. In this case, for the heat responsive material used as the shell of the microcapsule, there may be used a material such that the shell structure is decomposed, eliminated, broken, or the like after heat treatment, due to decomposition, softening, compatibility with a surrounding member, and the like, by means of the heat treatment, so as to maintain a condition where the substances are readily diffused through the inside and outside of the microcapsule permanently (irreversibly) (such as a heat decomposable material which is decomposed by heating, a thermoplastic such as a thermoplastic resin, and a heat compatible material which is compatible with a surrounding member by heating).

By so doing, at the time of color formation step, the substance permeability of the microcapsule shell is irreversibly increased, and the conditions are maintained. Therefore, the first component and the second component brought into a state capable of reaction after applying the controlling stimulation (irradiation of color forming information applying light) (or maintaining the state capable of reaction even after applying the controlling stimulation), may be sufficiently reacted readily to the end. As a result, at the time of the color formation step, sufficient color density may be maintained, and even if printed matter is left under a high temperature environment after the image formation, change of color balance due to decoloration of the image which is once formed, may be suppressed.

(Color Formation Type of Toner (Photo-Induced Color Forming and Non-Photo-Induced Color Forming))

The toner of an aspect of the present invention using a combination of the heat responsive microcapsule and the photocurable composition described above, may be any one of the following two types.

(1) A toner (hereunder, also called "photo-induced color forming toner") which maintains the state incapable of forming a color when the photocurable composition is uncured, and the photocurable composition is cured by irradiating light having a specific wavelength which cures the photocurable composition, so as to irreversibly control from the state incapable of forming a color to the state capable of forming a color.

(2) A toner (hereunder, also called "non-photo-induced color forming toner") of a type which maintains the state capable of forming a color when the photocurable composition is uncured, and the photocurable composition is cured by irradiating light having a specific wavelength which cures the photocurable composition, so as to irreversibly control from the state capable of forming a color to the state incapable of forming a color.

The main difference between the photo-induced color forming toner and the non-photo-induced color forming toner is in the material constituting the photocurable composition. In the photo-induced color forming toner, the photocurable composition contains at least a (non photopolymerizable) second component and a photopolymerizable compound, whereas in the non-photo-induced color forming toner, the photocurable composition contains at least a second component having a photopolymerizable group in the molecule.

The photocurable composition used for the photo-induced color forming toner and the non-photo-induced color forming toner may contain a photopolymerization initiator, and may contain other various materials as required.

As the photopolymerizable compound and the second component used for the photo-induced color forming toner, there is used materials such that an interaction occurs between both materials while the photocurable composition is uncured, so as to suppress diffusion of the second component in the photocurable composition, and the interaction between both materials is decreased after the photocurable composition (polymerization of the photopolymerizable compound) is cured by irradiating color forming information applying light, so as to facilitate the diffusion of the second component in the photocurable composition (details of these materials contained in the photocurable composition are described later).

Consequently, in the photo-induced color forming toner, the second component is trapped in the photopolymerizable compound when color forming information applying light is not irradiated and the photocurable composition is uncured. Consequently, in this condition, even if a stimulation to increase the substance permeability of the microcapsule shell is applied, the second component can not be in contact with the first component in the microcapsule, maintaining a state incapable of reaction between the first component and the second component (color formation reaction) (state incapable of color formation).

On the other hand, if color forming information applying light of a wavelength to cure the photocurable composition is irradiated to cure the photocurable composition, the second component contained in the photocurable composition is readily diffused. Consequently, in this condition, if the substance permeability of the microcapsule shell is increased by applying a color forming stimulation such as heat treatment, there is brought a state capable of reaction between the first component in the microcapsule and the second component in the photocurable composition (color formation reaction) (state capable of color formation).

Since the curing reaction of the photocurable composition is irreversible, once this is controlled into a state capable of color formation, this state is permanently maintained.

Consequently, for example, in the case where a heat responsive microcapsule is used as the microcapsule, if the color forming information applying light is irradiated to cure the photocurable composition, so as to control the toner into a state capable of color formation, and subsequently a heat treatment is applied, then the substance permeability of the heat responsive microcapsule shell is increased, bringing a reaction between the first component and the second component, so that the toner may form a predetermined color and this color formation state may be stably maintained. Conversely, if the color forming information applying light to cure the photocurable composition is not irradiated, the photocurable composition continuously maintains the uncured state, and even if the substance permeability of the heat responsive microcapsule shell is increased by means of heat treatment, the first component and the second component can not be reacted. Consequently, for example, if the color of the toner before color formation is colorless and transparent, this state is stably maintained.

In the photo-induced color forming toner described above, the color formation reaction between the first component and the second component is controlled by a process of two stages, that is: (1) reaction of curing of the photocurable composition by irradiating color forming information applying light of a wavelength to cure the photocurable composition; and (2) increase of the substance permeability of the microcapsule shell by applying a color forming stimulation such as heat treatment.

With respect to this, a color formation reaction of a toner using a photoresponsive bimolecular film as a capsule wall described in JP-A No. 2003-330228, also includes a process of bringing into a state capable of color formation reaction (substance diffusion) by light irradiation, and accelerating the substance diffusion by heating, so as to bring into the reaction.

However, the process at the first stage (curing of the photocurable composition) to determine whether or not to control from the state incapable of color formation to the state capable of color formation, is irreversible in the photo-induced color forming toner, whereas the process at the first stage (photoisomerization reaction of bimolecular film) is reversible in the toner described in JP-A No. 2003-330228.

Consequently, since the process at the first stage is reversible in the toner described in JP-A No. 2003-330228, the color formation reaction at the second stage is continuously more or less affected by the process at the first stage, and therefore the color formation reaction is difficult to control. As a result, the color density at the time of image formation becomes uneven.

Conversely, since the color formation reaction at the second stage can be controlled without being affected by the process at the first stage in the photo-induced color forming toner, then the color formation reaction may be readily controlled, the color density at the time of image formation may be readily maintained, and the change of color balance after image formation may be readily suppressed. In addition, the substance permeability of the microcapsule shell is irreversibly increased, and thereby further precise control becomes possible. Furthermore, the gradation of the color density may be controlled by the degree of curing (polymerization) of the photocurable composition, that is an irreversible reaction. Therefore, the gradation of the color density may be also readily controlled.

As described above as the photopolymerizable compound, the photo-induced color forming toner may be either a type (hereunder, also called "first photo-induced color forming toner") of using a photopolymerizable compound having a characteristic to trap the second component while the photocurable composition is uncured, or a type (hereunder, also called "second photo-induced color forming toner") of using a photopolymerizable compound containing a decoloring reaction group which inhibits the color formation reaction between the first component and the second component by reacting with the first component, in the molecule.

In the second photo-induced color forming toner, for example if a heat responsive microcapsule is used as the microcapsule, when color forming information applying light of a wavelength to cure the photocurable composition is irradiated, the photocurable composition is cured (that is, the photopolymerizable compound containing a decoloring reaction group is polymerized). Therefore, even if heat treatment is performed next, the color formation reaction between the first component and the second component is not inhibited by the decoloring reaction group (substance diffusion does not occur even by heating, due to polymerization), so that the color can be formed. Conversely, if heat treatment is performed without irradiating color forming information applying light of a wavelength to cure the photocurable composition, the decoloring reaction group is reacted with the first component and inhibits the color formation reaction between the first component and the second component, so that the color can not be formed.

In this manner, in the second photo-induced color forming toner, by maintaining a state incapable of forming a color when the photocurable composition is uncured, and by curing the photocurable composition by irradiating light of a wavelength to cure the photocurable composition, the state incapable of forming a color may be controlled into the state capable of forming a color.

Moreover, in the non-photo-induced color forming toner, since the second component itself is photopolymerizable, even if color forming information applying light is irradiated, unless the wavelength of the light is a wavelength to cure the photocurable composition, the state where the second component contained in the photocurable composition is readily diffused, can be maintained. Consequently, if the substance permeability of the microcapsule shell is increased by applying color forming stimulation such as heat treatment in this state, there is brought a state capable of reaction between the first component in the microcapsule and the second component in the photocurable composition (color formation reaction) (state capable of color formation).

On the other hand, if the photocurable composition is cured by irradiating color forming information applying light of a wavelength to cure the photocurable composition, the second component contained in the photocurable composition is polymerized with each other, and hence the second component contained in the photocurable composition becomes extremely hard to be diffused. Therefore, even if a stimulation to increase the substance permeability of the microcapsule shell is applied in this state, the second component can not be in contact with the first component in the microcapsule, thus maintaining the state incapable of reaction between the first component and the second component (color formation reaction) (state incapable of forming a color).

Since the curing reaction of the photocurable composition is irreversible, once this is controlled into a state capable of color formation, this state is permanently maintained.

Consequently, for example, in the case where a heat responsive microcapsule is used as the microcapsule, if the color forming information applying light is irradiated to cure the photocurable composition, so as to control the toner into a state incapable of color formation, then even if heat treatment is applied to increase the substance permeability of the heat responsive microcapsule shell, the first component and the second component can not be reacted. Consequently, for example, if the color of the toner before color formation is colorless and transparent, this state is stably maintained.

On the other hand, if heat treatment is performed while the photocurable composition is uncured, that is, the toner can form a color, the substance permeability of the heat responsive microcapsule shell is increased, and the first component and the second component are reacted, so that the toner can form a predetermined color and this color formation state can be stably maintained.

In the non-photo-induced color forming toner described above, the color formation reaction between the first component and the second component is controlled substantially by a process at the first stage to increase the substance permeability of the microcapsule shell by applying the color forming stimulation such as heat treatment, in a state where the photocurable composition is uncured (in a state not passing through to the process of irradiating the color forming information applying light of a wavelength to cure the photocurable composition).

As a result, the color formation reaction may be readily controlled, the color density at the time of image formation may be readily maintained, and the change of color balance after image formation may be readily suppressed. In addition, the substance permeability of the microcapsule shell is irreversibly increased, and thereby further precise control becomes possible. Furthermore, the gradation of the color density may be controlled by the degree of curing (polymerization) of the photocurable composition, that is an irreversible reaction. Therefore, the gradation of the color density may be also readily controlled.

Moreover, if the toner is desired not to form a color, if the photocurable composition is cured by irradiating color forming information applying light before increasing the substance permeability of the microcapsule shell by applying a color forming stimulation such as heat treatment, the state incapable of color formation may be stably maintained.

With respect to this, a color formation reaction of a toner using a photoresponsive bimolecular film as a capsule wall described in JP-A No. 2003-330228, also includes a process of two stages where there is brought a state capable of color formation reaction (substance diffusion) by light irradiation, and where the substance diffusion is accelerated to bring into a reaction, by means of heating. The control of color formation is complicated. Furthermore, since the process at the first stage is reversible in the toner described in JP-A No. 2003-330228, the color formation reaction at the second stage is continuously more or less affected by the process at the first stage, therefore the color formation reaction is difficult to control. As a result, the color density at the time of image formation becomes uneven.

Next is a more detailed description of a structure of the toner of an aspect of the present invention, in the case where the toner contains the photocurable composition and the microcapsule dispersed in this photocurable composition.

In this case, the toner may contain only one color forming part containing the photocurable composition, and the microcapsule dispersed in this photocurable composition. However, it preferably has two or more thereof. Here, as described above, the "color forming part" means a continuous region capable of forming one specific color when an external stimulation is applied.

If the toner contains two or more color forming parts, although the toner may contain only one type of color forming part capable of forming one same color, more preferably it contains two or more types of color forming parts capable of forming different colors from each other. The reason is that the former case is limited to only one type of color that one toner particle can form, whereas the latter case has two or more colors.

Examples of two or more types of color forming parts capable of forming different colors from each other, include a combination including a yellow color forming part capable of forming yellow, a magenta color forming part capable of forming magenta, and a cyan color forming part capable of forming cyan.

In this case, for example, if only one type of color forming part forms a color by applying an external stimulation, the toner may form any one of yellow, magenta, and cyan. If two types of color forming part form colors, there may be formed a color in combination of these two types of colors of these two color formation parts, and various colors may be expressed by one toner particle.

The control of the formed color if the toner contains two or more types of color forming parts capable of forming different colors from each other, can be realized by having different types or combinations of the first components and the second components contained in respective types of color forming parts, and by having different light wavelengths used for curing the photocurable compositions contained in respective types of color forming parts.

That is, in this case, since the light wavelengths used for curing the photocurable compositions contained in the color forming parts differ by each type of color forming part, multiple types of color forming information applying light having different wavelengths corresponding to the types of color forming parts may be used as the controlling stimulation. In order to have different light wavelengths required for curing the photocurable compositions contained in the color forming parts, the photocurable compositions may contain photopolymerization initiators that are sensitive to different wavelengths for each type of color forming part.

For example, if the toner contains three types of color forming parts capable of forming yellow, magenta, and cyan, then by using a material which is curable in response to any one of light wavelengths of 405 nm, 532 nm, and 657 nm as a photocurable composition contained in each type of color forming part, and by using color forming information applying light (light having a specific wavelength) of these three different wavelengths separately, the toner can form a desired color.

The wavelength of color forming information applying light may be selected from wavelengths in the visible region, however it may be selected from wavelengths in the ultraviolet region. Since the wavelength is short, there is a merit of readily narrowing the beam diameter (high definition is possible). As a light source of such wavelength, there are a wavelength conversion solid SHG laser (which converts fundamental wavelength to ½), and a gas laser.

Moreover, by selecting the wavelength of color forming information applying light not from wavelengths in the visible region, but from the infrared region, there is a merit of lower cost of the light emission element itself and readily obtaining a high output, as is conventionally known.

The toner used for an aspect of the present invention may contain a parent material having a main component of a binder resin that is similar to one used for a conventional toner using a colorant such as a pigment. In this case, the parent material may be dispersed with the two or more color forming parts respectively as a particulate capsule (hereunder, one capsule like color forming part is also called a "photosensitive/thermosensitive capsule"). Moreover, the parent material may contain a releasing agent and various additives, similarly to a conventional toner using a colorant such as a pigment.

The photosensitive/thermosensitive capsule is not specifically limited as long as it has a core containing a microcapsule and a photocurable composition, and a shell coating the core, and this shell can stably hold the microcapsule and the photocurable composition in the photosensitive/thermosensitive capsule, without leaking from the photosensitive/thermosensitive capsule in the manufacturing process of the toner described later, or during the preservation of the toner.

However, in an aspect of the present invention, in the manufacturing process of the toner described later, in order to prevent the second component from passing through the shell to flow out to the matrix outside of the photosensitive/thermosensitive capsule, and the second component in the photosensitive/thermosensitive capsule capable of forming another color from passing through the shell and entering thereinto, a water-insoluble material such as a binder resin of a water-insoluble resin or a releasing material is preferably contained as a main component, and more preferably a water-insoluble resin such as styrene-acrylic copolymer and polyester is used.

The toner used in an aspect of the present invention may have either a structure where the photosensitive/thermosensitive capsule (color forming part) is dispersed in the above-mentioned parent material (hereunder, also called "color forming part dispersion structure"), or a structure where two or more color forming parts are formed in layers (hereunder, one color forming part formed in a layer is also called a "photosensitive/thermosensitive layer").

Here, examples of the aspect where two or more color forming parts are formed in layers include (1) an aspect where a photosensitive/thermosensitive layer forms a core layer, and one or more photosensitive/thermosensitive layers are sequentially laminated on the core layer so as to cover this core layer (hereunder, also called "concentric circle structure"), (2) an aspect where a cross section obtained by cutting the toner from a predetermined direction includes two or more photosensitive/thermosensitive layers laminated in belt shapes (hereunder, also called "stripe structure"), and (3) an aspect where a cross section obtained by cutting the toner from a predetermined direction is sectioned in fan shapes having the center of the toner as a base point, and the respective fan-shaped areas include the photosensitive/thermosensitive layers (hereunder, also called "fan structure").

In any one of the concentric circle structure, the stripe structure, and the fan structure, between two adjacent photosensitive/thermosensitive layers is preferably provided an interlayer containing a material constituting the shell of the photosensitive/thermosensitive capsule mentioned above. Moreover, similarly to a conventional toner using a colorant such as a pigment, the interlayer may contain a releasing agent and various additives. Furthermore, the most outer surface of these three types of toners may be provided with a coating layer containing a binder resin.

Figure 6:
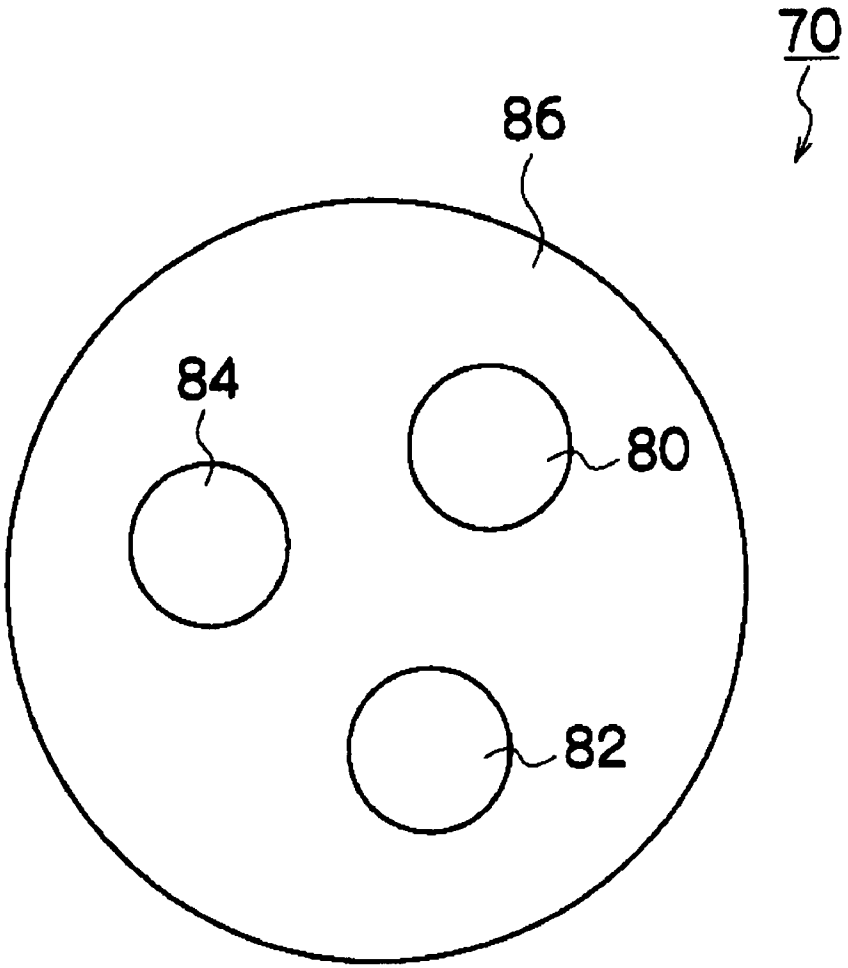
FIG. 6 is a schematic cross-sectional view showing an example of the toner structure (containing a parent material and a color forming part dispersed in the parent material)
Figure 7:
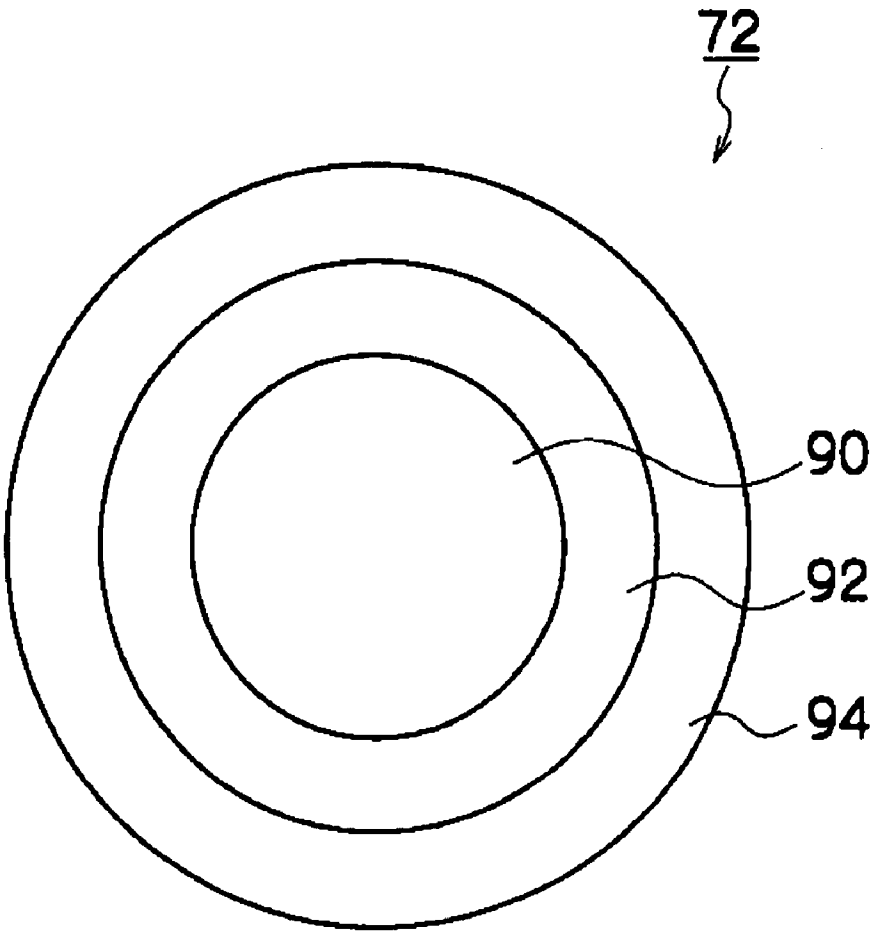
FIG. 7 is a schematic cross-sectional view showing another example of the toner structure (concentric circle structure)
Figure 8:
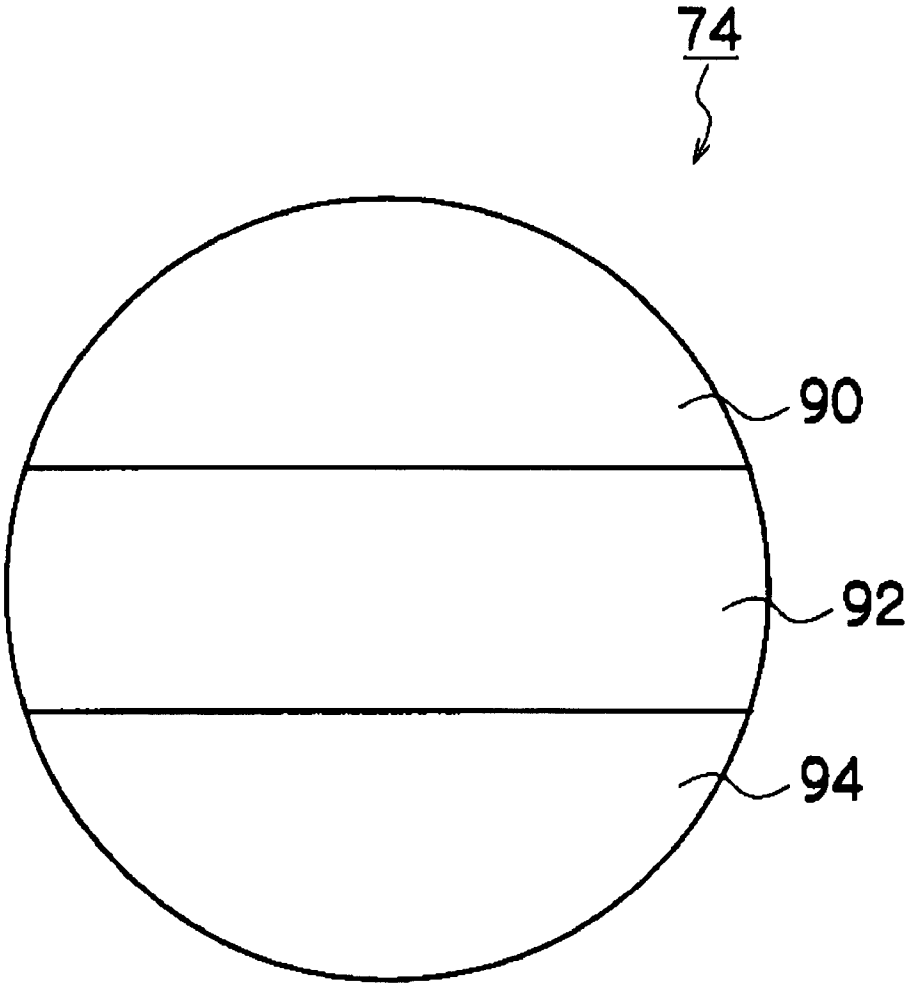
FIG. 8 is a schematic cross-sectional view showing another example of the toner structure (stripe structure)
Figure 9:
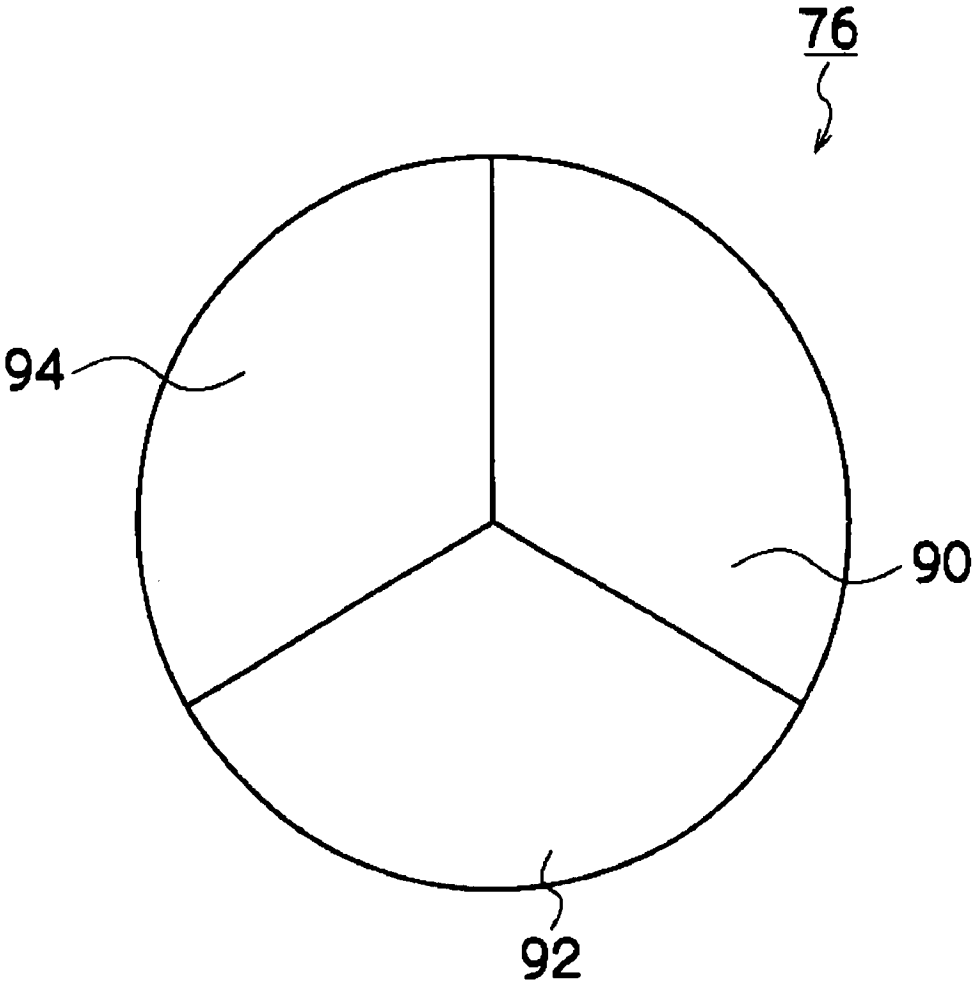
FIG. 9 is a schematic cross-sectional view showing another example of the toner structure (fan structure).

FIG. 6 is a schematic cross-sectional view showing an example of the toner of an aspect of the present invention containing a parent material and a color forming part dispersed in the parent material. FIG. 7 is a schematic cross-sectional view showing an example where the toner structure of an aspect of the present invention is a concentric circle structure. FIG. 8 is a schematic cross-sectional view showing an example where the toner structure of an aspect of the present invention is a stripe structure. FIG. 9 is a schematic cross-sectional view showing an example where the toner structure of an aspect of the present invention is a fan structure.

In FIG. 6 to FIG. 9, reference symbols 70, 72, 74, and 76 denote a toner, 80 denotes a first color forming part, 82 denotes a second color forming part, 84 denotes a third color forming part, 86 denotes a parent material, 90 denotes a first photosensitive/thermosensitive layer, 92 denotes a second photosensitive/thermosensitive layer, and 94 denotes a third photosensitive/thermosensitive layer. FIG. 6 to FIG. 9 show only a main part of the toner, and an interlayer provided between two adjacent photosensitive/thermosensitive layers and a coating layer provided on the most outer surface of the toner are omitted.

In the toner 70 shown in FIG. 6, three types of color forming parts 80, 82, and 84 are dispersed in the parent material 86, where they can respectively develop yellow, magenta, and cyan.

Moreover, the toner 72 shown in FIG. 7 includes a first photosensitive/thermosensitive layer 90 forming a core layer, having a second photosensitive/thermosensitive layer 92 and a third photosensitive/thermosensitive layer 94 sequentially laminated thereon. The toner 74 shown in FIG. 8 includes a belt-shaped second photosensitive/thermosensitive layer 92, having a first photosensitive/thermosensitive layer 90 and a third photosensitive/thermosensitive layer 94 arranged on both sides thereof. The toner 76 shown in FIG. 9 includes three photosensitive/thermosensitive layers 90, 92, and 94 in respective areas equally divided in three fan shapes having the center of the toner 76 as a base point. In the toners 72, 74, and 76 shown in FIG. 7 to FIG. 9, three photosensitive/thermosensitive layers 90, 92, and 94 are respectively capable of forming yellow, magenta, and cyan for example.

A toner having a structure where the color forming part is dispersed in the parent material, or a toner having the concentric circle structure may be produced using for example an aggregation coalescence method described later. The toner having the concentric circle structure, the stripe structure, or the fan structure may be produced using a wet production method using a microreactor.

The toner of an aspect of the present invention may be a toner containing two or more color forming parts such as the color forming part dispersion structure, the concentric circle structure, the stripe structure, and the fan structure shown in FIG. 6 to FIG. 9. The toner of an aspect of the present invention may be a toner containing only one color forming part. In this case, one color forming part itself may be used as a toner.

(Components of Non-Photo-Induced Color Forming Toner)

Next is a more detailed description of toner components used when the toner of an aspect of the present invention is a non-photo-induced color forming toner, and materials/methods used for preparing the respective toner components.

In this case, for the toner, there is used at least a first component, a second component, a microcapsule containing the first component, and a photocurable composition containing the second component. The photocurable composition particularly preferably contains a photopolymerization initiator, and various auxiliaries may be contained. Moreover, in the microcapsule (core), the first component may be present in a solid state, however it may be present together with a solvent.

In the non-photo-induced color forming toner, as the first component, there is used an electron donating colorless dye, a diazonium salt compound, or the like. As the second component, there is used an electron accepting compound having a photopolymerizable group, a coupler compound having a photopolymerizable group, or the like.

In addition to the materials described above, there is further appropriately used various materials similar to materials contained in a conventional toner using colorants; that is, a binder resin, a releasing agent, an internal additive, an external additive, and the like, as required. Hereunder is a more detailed description of the respective materials.

—First Component and Second Component—

The combinations of the first component and the second component suitably include the following combinations of (A) to (R) (in the following examples, the former means the first component and the latter means the second component).

(A) a combination of an electron donating colorless dye and an electron accepting compound.

(B) a combination of a diazonium salt compound and a coupling component (hereunder, sometimes called a "coupler compound").

(C) a combination of an organic acid metal salt such as silver behenate and silver stearate, and a reductant such as protocatechinic acid, spiroindan, and hydroquinone.

(D) a combination of long-chain aliphatic iron salt such as ferric stearate and ferric myristate, and phenols such as tannic acid, gallic acid, and ammonium salicylate (E) a combination of an organic acid heavy metal salt such as nickel, cobalt, lead, copper, iron, mercury or silver salt of acetate, stearate or palmitate, and an alkali metal or alkaliearth metal sulfide such as calcium sulfide, strontium sulfide and potassium sulfide, or a combination of the aforementioned organic acid heavy metal salt and an organic chelating agent such as s-diphenylcarbazide or diphenylcarbazone (F) a combination of heavy metal sulphate such as silver sulfate, lead sulfate, mercury sulfate and sodium sulfate, and a sulfur compound such as sodium tetrathionate, sodium thiosulfate, and thiourea.

(G) a combination of an aliphatic ferric salt such as ferric stearate, and an aromatic polyhydroxy compound such as 3,4-dihydroxytetraphenyl methane.

(H) a combination of organic metal salt such as silver oxalate and mercury oxalate, and an organic polyhydroxy compound such as polyhydroxy alcohol, glycerine and glycol.

(I) a combination of aliphatic ferric salt such as ferric pelargonate and ferric laurate, and a thiocecylcarbamide or isothiocecylcarbamide derivative (J) a combination of an organic acid lead salt such as lead caproate, lead pelargonate and lead behenate, and a thiourea derivative such as ethylene thiourea and N-dodecylthiourea.

(K) a combination of a heavy metallic salt of higher fatty acid such as ferric stearate and copper stearate, and zinc dialkyldithiocarbamate.

(L) a combination of compounds which form an oxazine dye such as resorcinol and a nitroso compound.

(M) a combination of a formazan compound, and a reductant and/or metallic acid.

(N) a combination of a protected dye (or a leuco dye) precursor and a protector-removing agent.

(O) a combination of an oxidation-type color former and an oxidizing agent.

(P) a combination of a phthalonitrile and a diiminoisoindoline (a combination that forms phthalocyanine).

(Q) a combination of an isocyanate and a diiminoisoindoline (a combination that forms a coloring pigment).

(R) a combination of a pigment precursor and an acid or base (a combination that forms a pigment).

As the first component used in an aspect of the present invention described above, an electron donating colorless dye that is substantially colorless, or a diazonium salt compound is preferable.

As the electron donating colorless dye, any conventionally publicly known dye may be used as long as it reacts with the second component to form a color. Specific examples thereof include various compounds such as phthalide compounds, fluoran compounds, phenothiazine compounds, indolylphthalide compounds, leucoauramine compounds, rhodaminelactum compounds, triphenylmethane compounds, triazene compounds, spiropyran compounds, pyridine compounds, pyrazine compounds and fluorene compounds. The electron donating colorless dye used for an aspect of the present invention is not limited to these.

If a full color image is formed in an aspect of the present invention, there are particularly preferably used electron donating colorless dyes for respective dyes forming colors of cyan, magenta, and yellow.

As to the cyan, magenta, and yellow forming dyes, there may be used respective dyes described in U.S. Pat. No. 4,800,149 and the like. Furthermore, as to the electron donating colorless dye for yellow forming dyes, there may be used dyes described in U.S. Pat. No. 4,800,148 and the like. As to the electron donating colorless dye for cyan forming dyes, there may be used dyes described in JP-A No. 63-53542 and the like.

For example if the toner has a structure as shown in FIG. 6 to FIG. 9, the dosage of the electron donating colorless dye is preferably 0.01 to 3 g/m$^2$, and more preferably 0.1 to 1 g/m$^2$ in the photosensitive/thermosensitive capsule (or the photosensitive/thermosensitive layer). If the dosage is less than 0.01 g/m$^2$, sufficient color density may not be obtained. If it exceeds 3 g/m$^2$, the photosensitive/thermosensitive capsule (or the photosensitive/thermosensitive layer) may be hardly formed. The dosage of the electron donating colorless dye in the case where the toner of an aspect of the present invention has a structure including only one color forming part is similar to the above.

The diazonium salt compound may include a compound represented by the following formula (1).

$$Ar—N_2^+X^- \qquad \text{formula (1)}$$

In the formula, Ar represents an aromatic ring group, and $X^-$ represents an acid anion.

This diazonium salt compound is a compound which reacts with a coupler to cause a coupling reaction so as to form a color, or a compound which is decomposed by light. The maximum absorption wavelength may be controlled by the position and the type of a substituent on the Ar site.

The maximum absorption wavelength $\lambda_{max}$ of the diazonium salt compound used for an aspect of the present invention is preferably 450 nm or less, and more preferably 290 to 440 nm, from the point of its effect. Moreover, the diazonium salt compound used for an aspect of the present invention preferably has 12 carbon atoms or more, 1 mass % or less of solubility with respect to water, and 5 mass % or more of solubility with respect to ethyl acetate.

Only one type of the diazonium salt compound may be used, or two or more types thereof may be used together according to its purpose such as tone adjustment.

For example if the toner of an aspect of the present invention has a structure as shown in FIG. 6 to FIG. 9, the dosage of the diazonium salt compound is preferably 0.01 to 3 g/m$^2$, and more preferably 0.02 to 1.0 g/m$^2$ in the photosensitive/thermosensitive capsule (or the photosensitive/thermosensitive layer). If the dosage is less than 0.01 g/m$^2$, sufficient color formation may not be obtained. If it exceeds 3 g/m$^2$, the sensitivity may be decreased, and the time for light irradiation performed as required after fixing may be required to be elongated. The dosage of the diazonium salt compound in the case where the toner of an aspect of the present invention has a structure including only one color forming part is similar to the above.

The second component used for an aspect of the present invention is a substantially colorless compound having a photopolymerizable group and a site which reacts with the first component to form a color, in one molecule, and there may be used any type such as an electron accepting compound having a photopolymerizable group and a coupler compound having a photopolymerizable group, as long as it has both functions of reacting with the first component to form a color, and reacting with light to be polymerized and cured.

As to the electron accepting compound having a photopolymerizable group, that is, a compound having an electron accepting group and a photopolymerizable group in one molecule, any type may be used as long as it has a photopolymerizable group, reacts with an electron donating colorless dye that is one of the first components to form a color, and is photopolymerized and cured.

Examples of the electron accepting compound include compounds that can be synthesized with reference to 3-halo-4-hydroxybenzoic acid described in JP-A No. 4-226455, a methacryloxyethyl ester and acryloxyethyl ester of benzoic acids having a hydroxyl group described in JP-A No. 63-173682, esters of benzoic acid having a hydroxyl group and hydroxymethylstyrene described in JP-A Nos. 59-83693, 60-141587 and 62-99190, hydroxystyrene described in European Patent No. 29323, an N-vinylimidazole complex of zinc halogenate described in JA-A Nos. 62-167077 and 62-16708, and an electron-accepting compound described in JP-A No. 63-317558.

Among the compounds having an electron accepting group and a polymerizable group in one molecule, a 3-halo-4-hydroxybenzoic acid represented by the following formula is preferred.

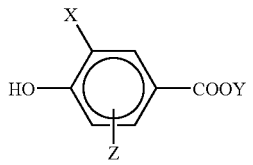

In the formula, X represents a halogen atom, preferably a chlorine atom. Y represents a monovalent group having a polymerizable ethylene group, preferably an aralkyl group having a vinyl group, an acryloyloxyalkyl group, and a methacryloyloxyalkyl group, and more preferably an acryloyloxyalkyl group having from 5 to 11 carbon atoms and a methacryloyloxyalkyl group having from 6 to 12 carbon atoms. Z represents a hydrogen atom, an alkyl group, or an alkoxy group.

The electron accepting compound having the photopolymerizable group is used in combination with the electron donating colorless dye. In this case, the dosage of the electron accepting compound is preferably 0.5 to 20 mass parts, and more preferably 3 to 10 mass parts with respect to 1 mass part of the electron donating colorless dye to be used. If the dosage is less than 0.5 mass part, sufficient color density may not be obtained. If it exceeds 20 mass parts, the sensitivity may be decreased, and the photosensitive/thermosensitive capsule (or the photosensitive/thermosensitive layer) may be hardly formed.

Moreover, as to the coupler compound having a photopolymerizable group, any type may be used as long as it has a photopolymerizable group, reacts with a diazonium salt compound that is one of the first components to form a color, and is photopolymerized and cured. The coupler compound is coupled with a diazo compound in a basic atmosphere and/or neutral atmosphere, to form a dye, and multiple types thereof may be used together according to its purpose such as tone adjustment.

The coupler compound is used in combination with a diazonium salt compound. For example, if the toner of an aspect of the present invention has a structure as shown in FIG. 6 to FIG. 9, the dosage of the coupler compound is preferably 0.02 to 5 g/m$^2$, and more preferably 0.1 to 4 g/m$^2$ from the point of its effect, in the photosensitive/thermosensitive capsule (or the photosensitive/thermosensitive layer). If the dosage is less than 0.02 g/m$^2$, color formation may be inferior. If it exceeds 5 g/m$^2$, the photosensitive/thermosensitive capsule (or the photosensitive/thermosensitive layer) may be hardly formed. The dosage of the coupler compound in the case where the toner of an aspect of the present invention has a structure including only one color forming part is similar to the above.

Moreover, the dosage of the coupler compound is preferably 0.5 to 20 mass parts, and more preferably 1 to 10 mass parts with respect to 1 mass part of the diazonium salt compound. If the dosage is less than 0.5 mass part, sufficient color density may not be obtained. If it exceeds 20 mass parts, the photosensitive/thermosensitive capsule (or the photosensitive/thermosensitive layer) may be hardly formed.

The coupler compound can be used by adding a water-soluble polymer together with other components, followed by solid dispersion by a sand mill or the like, however it can be also used as an emulsified product by emulsifying with an appropriate emulsifying auxiliary. Here, the method of solid dispersion or emulsification is not particularly limited, and may be appropriately selected from publicly known methods. Details of the methods are described in JP-A No. 59-190886, JP-A No. 2-141279, and JP-A No. 7-17145.

Moreover, in order to accelerate the coupling reaction, it is preferred to use organic bases, such as tertiary amines, piperidines, piperazines, amidines, formamidines, pyridines, guanidines, and morpholine compounds.

Examples of the organic base are described in JP-A No. 57-123086, JP-A No. 60-49991, JP-A No. 60-94381, JP-A No. 9-071048, JP-A No. 9-077729 and JP-A No. 9-077737, and the like.

The dosage of the organic base is not specifically limited, however it is preferably 1 to 30 moles with respect to 1 mole of diazonium salt. Only one type of the organic base may be used, and two or more types thereof may be used together.

Moreover, in order to accelerate the color formation reaction, a color forming auxiliary may be added. Examples of the color forming auxiliary include phenol derivatives, naphthol derivatives, alkoxy-substituted benzenes, alkoxy-substituted naphthalenes, hydroxyl compounds, carboxylic amide compounds, and sulfonamide compounds. Since these compounds have an effect of decreasing the melting point of a coupler compound or a basic substance, or increasing the thermopermeability of the microcapsule wall (shell), it is considered that a high color density may be obtained.

—Photopolymerization Initiator—

Next is a description of a photopolymerization initiator used for an aspect of the present invention. The photopolymerization initiator generates radicals by irradiating color forming information applying light, to cause a polymerization reaction in the photocurable composition, and is capable of accelerating the reaction. The photocurable composition is cured by this polymerization reaction.

The photopolymerization initiator may be selected from publicly known photopolymerization initiators, preferably containing a spectral sensitizing compound having a maximum absorption wavelength between 300 and 1000 nm, and a compound which interacts with the spectral sensitizing compound.

However, if the compound which interacts with the spectral sensitizing compound has both structures of a borate site and a dye site having a maximum absorption wavelength between 300 and 1000 nm, the spectral sensitizing dye need not be used.

Examples of the publicly known photopolymerization initiator are described in U.S. Pat. No. 4,950,581 (column 20, line 35, to column 21, line 35). Moreover, the examples include triazine compounds, such as the triazines described in EP-A-137452, DE-A-2718254, DE-A-2243621, and U.S. Pat. No. 4,950,581 (column 14, line 60, to column 18, line 44).

If the photopolymerization initiator is used in a hybrid system, it may include a cationic photopolymerization initiator in addition to the free radical curing agent. Examples of the cationic photopolymerization initiator include a peroxide compound such as benzoyl peroxide and peroxides described in U.S. Pat. No. 4,950,581 (column 19, lines 17 to 25), an aromatic sulfonium or iodonium salt described in U.S. Pat. No. 4,950,581 (column 18, line 60, to column 19, line 10), and cyclopentadienyl-allene-iron (II) complex salt such as ($\eta^6$-isopropylbenzene)-($\eta^5$-cyclopentadienyl)-iron (II) hexafluorophosphate.

Furthermore, examples of the dye/boron compound include those described in JP-A No. 62-143044, JP-A No. 1-138204, JP-A No. 6-505287 (Published Japanese translation of PCT), JP-A No. 4-261406, and the like.

The spectral sensitizing compound having a maximum absorption wavelength between 300 and 1000 nm may have a maximum absorption wavelength in this wavelength region. A high sensitivity may be obtained by selecting an optional desired dye from the spectral sensitizing dyes in this wavelength region, and adjusting the photosensitive wavelength so as to match with a light source used for irradiating color forming information applying light.

The spectral sensitizing dye may be appropriately selected from publicly known compounds. Examples thereof include those described in "Research Disclosure", vol. 200, item 20036, December 1980; "Zoukanzai" (Sensitizers), pp. 160-163, K. Tokumaru and M. Ogawara ed., Kodansha Ltd., 1987, and the like.

Specific examples thereof include 3-ketocoumarin compounds described in JP-A No. 58-15603, thiopyrylium salts described in JP-A No. 58-40302, naphthothiazole merocyanine compounds described in Japanese Patent Application Publication (JP-B) Nos. 59-28328 and 60-53300, and merocyanine compounds described in JP-B Nos. 61-9621 and 62-3842, and JP-A Nos. 59-89303 and 60-60104.

Dyes described in "Kinousei Sikiso no Kagaku" (Chemistry of Functional Dyes), pp. 393-416, CMC Press 1981; and, "Shikizai" (Coloring Materials), vol. 60 (4), pp. 212-224; (1987) can also be included. Specific examples thereof include a cationic methine dye, a cationic carbonium dye, a cationic quinonimine dye, a cationic indoline dye and a cationic stylyl dye.

The spectral sensitizing dye also includes: keto dyes, such as coumarin (including ketocoumarin and sulfocoumarin) dyes, merostyryl dyes, oxonole dyes, and hemioxonole dyes; non-keto dyes, such as non-ketopolymethine dyes, triarylmethane dyes, xanthene dyes, anthracene dyes, rhodamine dyes, acridine dyes, aniline dyes, and azo dyes; non-ketopolymethine dyes, such as azomethine dyes, cyanine dyes, carbocyanine dyes, dicarbocyanine dyes, tricarbocyanine dyes, hemicyanine dyes, and styryl dyes; and quinonimine dyes, such as azine dyes, oxazine dyes, thiazine dyes, quinoline dyes, and thiazole dyes.

The spectral sensitivity of the photopolymerization initiator used for the toner may be obtained in a region from ultraviolet to infrared by appropriately using the spectral sensitizing dye. Only one type of the sensitizing dye may be used, or two more types thereof may be used in combination.

For example if the toner of an aspect of the present invention has a structure as shown in FIG. 6 to FIG. 9, the dosage of the spectral sensitizing compound is preferably 0.1 to 5 mass parts, and more preferably 0.5 to 2 mass parts with respect to the gross weight of the material constituting the photosensitive/thermosensitive capsule (or the photosensitive/thermosensitive layer). This is similar to the case where the toner of an aspect of the present invention has a structure including only one color forming part.

As to the compound which interacts with the spectral sensitizing compound, one or more compounds may be appropriately selected and used from publicly known compounds capable of initiating a photopolymerization reaction with the photopolymerizable group in the second component.

By making this compound present together with the spectral sensitizing compound, it sensitively responds to the irradiated light in the spectral absorption wavelength region, to generate radicals with high efficiency. Therefore, the sensitivity may be increased, and generation of radicals may be controlled using an optional light source in a region from ultraviolet to infrared.

The "compound which interacts with the spectral sensitizing compound" is preferably an organic borate salt compound, benzoinethers, S-triazine derivatives having a trihalogen substituted methyl group, an organic peroxide, and an azinium salt compound, and more preferably an organic borate salt compound. By using this "compound which interacts with the spectral sensitizing compound" together with the spectral sensitizing compound, radicals may be generated locally and effectively in the exposed exposure unit portion, so as to achieve a higher sensitivity.

The organic borate salt compound includes organic borate compounds (hereunder, also called "borate compound I") described in JP-A No. 62-143044, JP-A No. 9-188685, JP-A No. 9-188686, JP-A No. 9-188710, and the like, or spectral sensitizing dye borate compounds (hereunder, also called "borate compound II") obtained from cationic dyes described in "Kinousei Sikiso no Kagaku" (Chemistry of Functional Dyes), pp. 393-416, CMC Press 1981; and, "Shikizai" (Coloring Materials), vol. 60(4), pp. 212-224; (1987).

This borate compound II is a compound having a dye site and a borate side in its structure, and has three functions of: effectively absorbing light source energy due to the photoabsorption function of the dye site, at the time of exposure; accelerating the polymerization reaction due to the radical emitting function of the borate site; and decoloring the spectral sensitizing compound that is present together.

Specifically, any dye may be suitably used as long as it is a cationic dye having a maximum absorption wavelength in a wavelength region of more than 300 nm, and preferably a wavelength region between 400 and 1100 nm. Preferred are cationic methine dyes, polymethine dyes, triarylmethane dyes, indoline dyes, azine dyes, xanthene dyes, cyanine dyes, hemicyanine dyes, rhodamine dyes, azamethine dyes, oxazine dyes, and acridine dyes, and more preferred are cationic cyanine dyes, hemicyanine dyes, rhodamine dyes, and azamethine dyes.

The borate compound II obtained from the organic cationic dye can be obtained by using an organic cationic dye and an organic boron compound anion, with reference to a method described in European Patent No. 223,587A1.

As described above, the borate compound II is a multifunctional compound. However, from the viewpoint of obtaining a high sensitivity and a sufficient decoloring property, in an aspect of the present invention, the photopolymerization initiator is preferably made of an appropriate combination of a spectral sensitizing compound and a compound which interacts with the spectral sensitizing compound. In this case, the photopolymerization initiator is more preferably a photopolymerization initiator (1) that is a combination of the spectral sensitizing compound and the borate compound I, or a photopolymerization initiator (2) that is a combination of the borate compound I and the borate compound II.

At this time, the usage ratio of the spectral sensitizing dye to the organic borate compound present in the photopolymerization initiator is very important from the point of obtaining a high sensitivity and a sufficient decoloring property (deactivation or decomposition of reactive substances that have not been reacted) by light irradiation in the photo irradiation step performed as required after color formation by means of heat treatment at the time of fixing for image formation.

In the case of the photopolymerization initiator (1), in addition to the ratio (=1/1:mole ratio) of spectral sensitizing compound/borate compound I required for the photopolymerization reaction, there may be further added the borate compound I of an amount required for sufficiently decoloring the spectral sensitizing compound remaining in the toner, from the point of obtaining a sufficiently high sensitivity and decoloring property.

That is, the ratio of spectral sensitizing dye/borate compound I is preferably within a range between 1/1 and 1/50 for usage, more preferably within a range between 1/1.2 and 1/30, and even more preferably within a range between 1/1.2 and 1/20. If the ratio is less than 1/1, a sufficient polymerization reactivity and decoloring property may not be obtained, and if it exceeds 1/50, the photosensitive/thermosensitive capsule (or the photosensitive/thermosensitive layer) can be hardly formed.

Moreover, in the case of the photopolymerization initiator (2), it is particularly preferable to use the borate compound I and the borate compound II in combination so that the borate site has an equal mole ratio or more with respect to the dye site, from the point of obtaining a sufficiently high sensitivity and decoloring property. The ratio of borate compound I/borate compound II is preferably within a range between 1/1 and 50/1 for usage, more preferably within a range between 1.2/1 to 30/1, and even more preferably within a range between 1.2/1 to 20/1. If the ratio is less than 1/1, less radicals are generated, and a sufficient polymerization reactivity and decoloring property may not be, and if it exceeds 50/1, a sufficient sensitivity may not be obtained.

The gross amount of the spectral sensitizing dye and the organic borate compound in the photopolymerization initiator is preferably within a range between 0.1 and 10 mass % with respect to the usage amount of the compound (second component) having a photopolymerizable group, more preferably within a range between 0.1 and 5 mass %, and even more preferably within a range between 0.1 and 1 mass %. If the usage amount is less than 0.1 mass %, the effect of an aspect of the present invention may not be obtained. If it exceeds 10 mass %, the preservation stability of the toner may be decreased and the photosensitive/thermosensitive capsule (or the photosensitive/thermosensitive layer) may be hardly formed.

—Auxiliaries—

Moreover, in order to accelerate the polymerization reaction, the photocurable composition may be further added with a reductant such as an oxygen scavenger or a chain transfer agent of an active hydrogen donor, or other compounds which accelerate the polymerization in a manner of chain transfer, as an auxiliary.

The oxygen scavenger includes phosphine, phosphate, phosphite, primary silver salt, and other compounds that are readily oxidized by oxygen. Specific examples thereof include N-phenylglycine, trimethylbarbituric acid, N,N-dimethyl-2,6-diisopropylaniline, and N,N,N-2,4,6-pentamethylaniline acid. Furthermore, thiols, thioketones, trihalomethyl compounds, Rofin dimmer compounds, iodonium salts, sulfonium salts, azinium salts, organic peroxides, azides, and the like are also useful as a polymerization accelerator.

(Microcapsulization)

In an aspect of the present invention, the first component such as an electron donating colorless dye and a diazonium salt compound is contained inside of the microcapsule to use.

For the microcapsulization method, a conventional publicly known method may be used. Examples thereof include a method using coacervation of hydrophilic wall forming materials described in U.S. Pat. Nos. 2,800,457 and 2,800,0458, an interfacial polymerization method described in U.S. Pat. No. 3,287,154, UK Patent No. 990443, and JP-B Nos. 38-19574, 42-446, and 42-771, a method due to polymer precipitation described in U.S. Pat. Nos. 3,418,250 and 3,660,304, a method using an isocyanate polyol wall material described in U.S. Pat. No. 3,796,669, a method using an isocyanate wall material described in U.S. Pat. No. 3,914,511, a method using wall forming materials such as urea-formaldehyde and urea formaldehyde-resorcinol described in U.S. Pat. Nos. 4,001,140, 4,087,376, and 4,089,802, a method using wall forming materials such as melamine-formaldehyde resins, and hydroxypropyl cellulose described in U.S. Pat. No. 4,025,455, an in situ method due to monomer polymerization described in JP-B No. 36-9168, JP-A No. 51-9079, an electrolytic dispersion cooling method described in U.K. Patent Nos. 952807 and 965074, a spray drying method described in U.S. Pat. No. 3,111,407, UK Patent No. 930422, and methods described in JP-B No. 7-73069, JP-A No. 4-101885, and JP-A No. 9-263057.

The microcapsulization method is not limited to these. However, particularly, the interfacial polymerization method is preferably employed in an aspect of the present invention, where an oil phase prepared by dissolving or dispersing a first component in a hydrophobic organic solvent that becomes a core of the capsule is mixed with an aqueous phase in which a water-soluble polymer is dissolved followed by emulsifying and dispersing by means of such as a homogenizer, further followed by heating, so that a polymer forming reaction is caused at an oil/water interface, so as to form a microcapsule wall made of a polymer. In the interfacial polymerization method, capsules having uniform particle diameters can be formed in a short time, and a toner having a superior stock storability can be obtained.

Examples of preferable microcapsules in an aspect of the present invention include those in which, at normal temperatures, substances inside and outside of the capsule are inhibited from contacting with each other due to a substance segregation function of the microcapsule wall (shell), and only when heat and/or pressure is applied to a certain value or more, the substances inside and outside of the capsule can be made into contact. This phenomenon can be freely controlled as the variation of the physical properties of the capsule, by appropriately selecting the material of the microcapsule wall, the substance contained in the microcapsule, and the additives.

The material of the microcapsule wall used in an aspect of the present invention is added inside and/or outside of oil droplets. Examples of the material of the microcapsule wall include polyurethane, polyurea, polyamide, polyester, polycarbonate, urea-formaldehyde resin, melamine resin, polystyrene, styrene-methacrylate copolymer and styrene-acrylate copolymer. Among these, polyurethane, polyurea, polyamide, polyester and polycarbonate are preferable, and polyurethane and polyurea are more preferable. Two or more types of the polymer substances may be used together.

All components such as the first component may be used by solid dispersion by means of a sand mill or the like, together with for example a water-soluble polymer, a sensitizer, and other color forming auxiliaries. However, the components may be used as an emulsified and dispersed matter that is obtained by previously dissolving the components in a water slightly soluble or insoluble organic solvent having a high boiling point, and mixing the resulting mixture with a water-soluble polymer solution (aqueous phase) containing a surfactant and/or water-soluble polymer as the protective colloid, followed by emulsifying by means of a homogenizer. In this case, as required, a low boiling point solvent may be used as a dissolving auxiliary. Furthermore, all components such as the first component can be emulsified and dispersed separately from each other, or can be previously mixed, then dissolved in a high boiling point solvent and/or low boiling point solvent and emulsified and dispersed. The size of the emulsified and dispersed particles may be 1 μm or less.

After emulsification, the emulsified matter is heated to 30 to 70° C., in order to accelerate the microcapsule wall forming reaction. Moreover, during the reaction, in order to prevent the capsules from being cohered to each other, it is required to add water to decrease the probability of collision between the capsules, to sufficiently stir, and the like. On the other hand, during the reaction, a dispersed matter for preventing cohesion may be separately added. The end point of the microcapsule wall forming reaction can be approximately considered to be the time, after carbon dioxide generation is observed together with the progress of the polymerization reaction, and when the generation is ended. Normally, by performing the reaction for several hours, the microcapsule containing the first component inside can be obtained.

The volume average particle size of the microcapsule is preferably adjusted to be within a range between 0.1 and 3.0 μm, and more preferably within a range between 0.3 and 1.0 μm.

In the toner having a structure as shown in FIG. 6 to FIG. 9, a binder may be contained in the photosensitive/thermosensitive capsule (or the photosensitive/thermosensitive layer). This is similar to the case where the toner has only one color forming part.

As the binder, there may be used, as well as a binder that is similar to the one used for emulsifying and dispersing the photocurable composition, and a water-soluble polymer used for capsulizing the first reactive substance, polystyrene, polyvinyl formal, polyvinyl butyral, acrylic resins such as polymethyl acrylate, polybutyl acrylate, polymethyl methacrylate, polybutyl methacrylate, and copolymers thereof, phenol resins, styrene-butadiene resins, ethyl cellulose, epoxy resins, urethane resins, and other solvent soluble polymers, and polymer latexes thereof. Among these, gelatin and polyvinyl alcohol are preferred. Moreover, a binder resin described later may be used as the binder.

Furthermore, as required, additives such as a dye, an ultraviolet absorber, a plasticizer, a fluorescent whitening agent, a curing agent, and an antistatic agent may be used. Specific examples of the additive are described in Research Disclosure, Vol. 176 (December 1978, Item 17643) and Research Disclosure, Vol. 187 (November 1979, Item 18716).

—Curing Agent—

In the toner having a structure as shown in FIG. 6 to FIG. 9 of an aspect of the present invention, a curing agent may be used together for the respective layers such as the photosensitive/thermosensitive capsule (or the photosensitive/thermosensitive layer) and the interlayer.

As the curing agent, for example a "gelatin curing agent" used for producing a photosensitive material is useful. Examples thereof include: aldehydes such as formaldehyde and glutaraldehyde; reactive halogen compounds described in U.S. Pat. No. 3,635,718; compounds having a reactive ethylenically unsaturated bond described in U.S. Pat. No. 3,635,718; aziridine compounds described in U.S. Pat. No. 3,017,280; epoxy compounds described in U.S. Pat. No. 3,091,537; halogenocarboxyaldehydes such as mucochromic acid; dioxanes such as dihydroxydioxane and dichiorodioxane; vinyl sulfones described in U.S. Pat. Nos. 3,642,486 and 3,687,707; vinyl sulfone precursors described in U.S. Pat. No. 3,841,872; and keto-vinyls described in U.S. Pat. No. 3,640,720. Moreover, inorganic curing agents such as chrome alum, zirconium sulfate, and boric acid may be used.

—Binder Resin—

In the toner of an aspect of the present invention, a binder resin used for a conventional toner may be used. For example, in a toner having a structure where the photosensitive/thermosensitive capsule is dispersed in the parent material as shown in FIG. 6, the binder resin can be used as a main component of the parent material or a constituent material of the shell of the photosensitive/thermosensitive capsule. In a toner having the concentric circle structure, the stripe structure, or the fan structure having two or more layer shaped color forming parts as shown in FIG. 7 to FIG. 9, the binder resin can be used as the coating layer coating the most outer surface of the toner, or a material of the interlayer provided between two adjacent color forming parts. However, it is not limited to these.

The binder resin is not specifically limited, and a publicly known crystalline or amorphous resin material may be used. In particular, in order to apply a low temperature fixing property, a crystalline polyester resin having a sharp melting property is useful.

The melting point of the crystalline resin is preferably 50 to 110° C., and more preferably 60 to 90° C. If the melting point is less than 50° C., the preservability of the toner and the preservability of the fixed toner image may have a problem. On the other hand, if it is more than 110° C., a sufficient low temperature fixing property may not be obtained compared to a conventional toner.

Moreover, the crystalline resin may show multiple melting peaks. However, in an aspect of the present invention, the melting point is considered as the maximum peak.

Moreover, as the amorphous polymer (amorphous resin), there may be used a publicly known resin materials such as a styrene-acrylic resin and a polyester resin, and particularly preferably an amorphous polyester resin. The amorphous polyester resin used in an aspect of the present invention may be obtained by condensation polymerization of polycarboxylic acids and polyalcohols mainly.

It is useful to use an amorphous polyester resin, from the point that the resin particle dispersion can be readily prepared by adjusting the acid value of the resin, or by emulsifying and dispersing using an ionic surfactant.

The amorphous polymer that can be used for the toner preferably has, in a molecular weight measurement by the gel permeation chromatography (GPC) method of a tetrahydrofuran (THF) soluble element, a weight average molecular weight (Mw) of 5000 to 1000000, and more preferably 7000 to 500000, and a number average molecular weight (Mn) of 2000 to 10000, and has a molecular weight distribution Mw/Mn of 1.5 to 100, and more preferably 2 to 60.

The glass-transition temperature of the amorphous polymer that can be used for the toner is preferably 35 to 100° C., and more preferably 50 to 80° C. from the point of preservation stability and the fixing property of the toner. If the glass-transition temperature is less than 35° C., the toner tends to cause blocking (phenomenon where toner particles are aggregated to become blocks) during preservation or in the developing device, whereas if the glass-transition temperature exceeds 100° C., the toner fixing temperature is increased.

Moreover, the softening point of the amorphous polymer is preferably within a range between 80 and 130° C., and more preferably within a range between 90 to 120° C. If the softening point is less than 80° C., the toner and the image stability of the toner after fixing or during preservation may be remarkably worsened. Moreover, if the softening point is more than 130° C., the low temperature fixing property may be worsened.

The softening point of the amorphous polymer is measured by a flow tester (CFT-500C manufactured by Shimazu Corporation), and denotes an intermediate temperature between a temperature at which the melting starts and a temperature at which the melting finishes, under a condition of preheat of 80° C./300 sec, plunger pressure of 0.980665 Mpa, dye size of 1 mmϕ×1 mm, and programming rate of 3.0° C./min.

—Releasing Agent—

The toner of an aspect of the present invention may contain a releasing agent. The releasing agent is generally used in order to increase the releasing property.

Examples of the releasing agent used for the toner are not specifically limited, and include: mineral, petroleum wax, and natural gas wax, such as montan wax, ozokerite, ceresin, paraffin wax, microcrystalline wax, and Fischer-Tropsch wax, and modified materials thereof; low molecular weight polyolefins such as polyethylene, polypropylene and polybutene; silicone compounds having a softening point upon heating; aliphatic amides such as oleic amide, erucic amide, recinoleic amide, and stearic amide; vegetable wax such as carnauba wax, rice wax, candelilla wax, Japan wax, and jojoba oil; and animal wax such as yellow beeswax. Moreover, the modified auxiliary component includes higher alcohols having 10 to 18 carbon atoms and mixtures thereof, and higher fatty acid monoglycerides having 16 to 22 carbon atoms and mixtures thereof. These may be used in combination.

—Other Additives—

The toner of an aspect of the present invention may contain other components than those described above. Other components are not specifically limited, and are appropriately selected according to the purpose. Example thereof include publicly known various additives such as inorganic particles, organic particles, and charge control agents which are used for conventional toners. Moreover, since the toner of an aspect of the present invention forms a color by itself, a colorant such as a pigment used for a conventional toner is basically unnecessary. However, in order to finely adjust the tone when a color is formed, a small amount of a publicly known colorant may be used as required.

The charge control agent is used in order to improve and stabilize the charging property. Examples of the charge control agent include dyes comprising a quaternary ammonium salt compound, a nigrosin compound, and complexes such as aluminum, iron, and chromium, and normally used various charge control agents such as a triphenylmethane pigment. However, if a toner is produced by an aggregation coalescence method described later, a material that is hardly-soluble in water may be used from the point of controlling the ionic strength which affects the stability of aggregated particles formed in the solution, and decreasing the waste water pollution.

Moreover, in order to give fluidity and improve the cleaning property, similarly to the normal toner, after drying, inorganic particles such as silica, alumina, titania, and calcium carbonate, or resin particles such as a vinyl resin, polyester, and silicone may be added to the toner surface as a fluidity auxiliary or a cleaning auxiliary, by shearing in a dry state.

(Toner Components of Photo-Induced Color Forming Toner)

Next is a more detailed description of toner components used when the toner of an aspect of the present invention is a photo-induced color forming toner, and materials/methods used for preparing the respective toner components.

In this case, for the toner, there is used at least a first component, a second component, a microcapsule containing the first component, and a photocurable composition containing a photopolymerizable compound and a second component. The photocurable composition may contain a photopolymerization initiator (or photopolymerization initiator system), and a spectral sensitizing dye and various auxiliaries may be contained. Moreover, in the microcapsule (core), the first component may be present in a solid state, however it may be present together with a solvent.

In the photo-induced color forming toner, as the first component, there is used an electron donating colorless dye. As the second component, there is used an electron accepting compound (also called an "electron accepting developer" or "developer"). As the photopolymerizable compound, in the case of the first photo-induced color forming toner, there is used a polymerizable compound having an ethylenic unsaturated bond. Components such as the electron donating colorless dye serving as the first component, the spectral sensitizing dye, and the various auxiliaries, and also the microcapsulization method are similar to those described in the above non-photo-induced color forming toner.

It is also similar to the non-photo-induced color forming toner in that, in addition to the materials described above, there is further appropriately used various materials similar to materials contained in a conventional toner using colorants; a binder resin, a releasing agent, an internal additive, an external additive, and the like as required.

—Polymerizable Compound Having an Ethylenic Unsaturated Bond (Photopolymerizable Compound)—

The polymerizable compound having an ethylenic unsaturated bond used for an aspect of the present invention is a polymerizable compound having at least one ethylenic unsaturated double bond in a molecule.

For example, there may be used, acrylic acid and the salt thereof, acrylic acid esters, acrylamides; methacrylic acid and the salt thereof, methacrylic acid esters, methacrylamides; maleic anhydride, maleic acid esters; itaconic acid, itaconic acid esters; styrenes; vinylethers; vinylesters; N-vinylheterocycles; aryl ethers; and allylic esters. Among these, a polymerizable compound including a hetero atom having at least one lone-pair electron in the molecule is preferred.

The hetero atom having at least one lone-pair electron mentioned here denotes each atom such as oxygen, nitrogen, sulfur, phosphorus, and halogen.

Specific examples thereof include those having an ester bond, an amide bond, a carbonyl bond, a thiocarbonyl bond, an ether bond, a thioether bond, and a group such as amine, alcohol, thioalcohol, phosphine, and halogen. Among these, preferred is a polymerizable compound having an ethylenic unsaturated bond which has at least one bond of an ester bond, an amide bond, an amine, a carbonyl bond, and/or an ether bond having a strong interaction with the electron accepting developer, in the molecule. Particularly preferred is a compound having an ester bond, or an amide bond, which are photopolymerizable.

Moreover, in order to make an advantageous polymerization efficiency (curing velocity), a polymerizable compound having multiple ethylenic unsaturated double bonds in a molecule may be used. Examples thereof include acrylic acid esters and methacrylic acid esters of polyhydric alcohol such as trimethylol propane and pentaerythritol; acrylate or methacrylate terminal epoxy resins; and acrylate or methacrylate terminal polyesters.

—Photopolymerization Initiator (or Photopolymerization Initiator System)—

As the photopolymerization initiator suitably used for an aspect of the present invention, one or a plurality of types of compounds may be selected in combination from compounds that can initiate photopolymerization among the compounds containing the ethylenic unsaturated bond.

Specific examples of the photopolymerization initiator include the following compounds: aromatic ketones such as benzophenone, 4,4'-bis(dimethylamino)benzophenone, 4-methoxy-4'-dimethylaminobenzophenone, 4,4'-dimethoxybenzophenone, 4-dimethylaminobenzophenone, 4-dimethylaminoacetophenone, benzil, anthraquinone, 2-tert-butylanthraquinone, 2-methylanthraquinone, xanthone, thioxanthone, 2-chlorothioxanthone, 2,4-diethylthioxanthone, fluorenone, acridone; benzoin and benzoin ethers such as benzoin methylether, benzoin ethylether, benzoin isopropylether, benzoin phenylether; 2,4,5-triarylimidazole dimers such as 2-(o-chlorophenyl)-4,5-diphenylimidazole dimmer, 2-(o-chlorophenyl)-4,5-di(m-methoxyphenyl)imidazole dimmer, 2-(o-fluorophenyl)-4,5-diphenylimidazole dimmer, 2-(p-methoxyphenyl)-4,5-diphenylimidazole dimmer, 2-(p-methoxphenyl)-4,5-diphenylimidazole dimmer, polyhalogen compounds such as carbon tetrabromide, phenyltribromomethylsulfone, phenyltrichloromethylketone; compounds described in respective specifications of JP-A No. 53-133428, JP-B No. 57-1819, JP-B No. 57-6096, and U.S. Pat. No. 3,615,455; S-triazines having a trihalogen substituted methyl group described in JP-A No. Sho 58-29803, such as 2,4,6-tris(trichloromethyl)-S-triazine, 2-methoxy-4,6-bis(trichloromethyl)-S-triazine, 2-amino acid-4,6-bis(trichloromethyl)-S-triazine, 2-(P-methoxystyryl)-4,6-bis(trichloromethyl)-S-triazine; organic peroxides described in, for example JP-A No. 59-189340, such as methylethylketone peroxide, cyclohexanone peroxide, 3,3,5-trimethylcyclohexanone peroxide, benzoylperoxide, ditertiary butyldiperoxyisophthalate, 2,5-dimethyl-2,5-di(benzoylperoxy)hexane, tertiary butylperoxybenzoate, a,a'-bis(tertiary butylperoxyisopropyl)benzene, dicumyl peroxide, and 3,3',4,4'-tetra-(tertiary butylperoxycarbonyl)benzophenone; azinium salt compounds described in for example U.S. Pat. No. 4,743,530; organic boron compounds described in for example Europe Patent No. 0223587, such as tetramethylammonium salt of triphenylbutylborate, tetrabutylammonium salt of triphenylbutylborate, and tetramethylammonium salt of tri(P-methoxyphenyl)butylborate; and other diaryliodonium salts, and iron allene complexes. In the field of photosensitive and heat sensitive recording material, well known photopolymerization initiators and the like may be usefully used.

The content of the photopolymerization initiator is preferably 0.01 to 20 mass %, more preferably 0.2 to 15 mass %, and even more preferably 1 to 10 mass %, with respect to the total weight of the photocurable composition. If it is less then 0.01 mass %, the sensitivity may become insufficient. If it exceeds 10 mass %, the sensitivity need not be expected to increase.

—Electron Accepting Developer (Second Component)—

Examples of the electron accepting developer include phenol derivatives, sulfur containing phenol derivatives, organic carboxylic acid derivatives (such as salicylic acid, stearic acid, and resorcinic acid), and the metal salts thereof, sulfonic acid derivatives, urea or thio urea derivatives, acid clay, bentonite, novolac resins, metal treated novolac resins, and metal complexes.

These examples are described in Kami Pulp Gijutsu Times (1985) pages 49 to 54 and 65 to 70, JP-B Nos. Sho 40-9309, and 45-14039, JP-A Nos. Sho 52-140483, 48-51510, 57-210886, 58-87089, 59-11286, 60-176795, 61-95988, and the like.

Only one type of these electron accepting compounds may be used, or two or more types thereof may be used together. The dosage of the electron accepting compound is preferably within a range between 10 and 4000 mass %, and more preferably between 100 and 2000 mass %, with respect to the electron donating colorless dye.

Furthermore, in addition to these compounds, a thermal polymerization inhibitor may be added into the photocurable composition as required. The thermal polymerization inhibitor is added in order to prevent the photocurable composition from being polymerized thermally or polymerized with time, and thereby the chemical stability can be increased at the time of preparing or preserving the photocurable composition. Examples of the thermal polymerization inhibitor include p-methoxyphenol, hydroquinone, t-butylcatechol, pyrogallol, 2-hydroxybenzophenone, 4-methoxy-2-hydroxybenzophenone, cuprous chloride, phenothiazine, chloranil, naphthylamine, β-naphthol, 2,6-di-t-butyl-p-cresol, nitrobenzene, dinitrobenzene, picric acid, and p-toluidine. The dosage of the thermal polymerization inhibitor is preferably 0.001 to 5 mass %, and more preferably 0.01 to 1 mass %, with respect to the electron donating colorless dye. If it is less than 0.001 mass %, the thermal stability becomes inferior. If it exceeds 5 mass %, the sensitivity may be decreased.

The photocurable composition may be contained inside of the microcapsule to use, as required. For example, with reference to Europe Patent No. 0223587 or the above patents, it can be contained inside of the microcapsule.

The volume average particle size of the microcapsule is preferably adjusted within a range between 0.1 and 3.0 μm, and more preferably within a range between 0.3 and 1.0 μm, similarly to the case of the photo-induced color forming toner.

Furthermore, the electron donating colorless dye may be present either in a liquid state or a solid state in the microcapsule. If a solvent is used together, the amount of the solvent in the capsule is preferably 1 to 500 mass parts with respect to 100 mass parts of the electron donating colorless dye.

Moreover, for the toner of an aspect of the present invention, an ultraviolet absorber may be used in order to improve the light resistance of the image, as required. As the ultraviolet absorber, there may be used a publicly known compound in the field, such as benzotriazole compounds, cinnamic acid ester compounds, aminoallylidenemalonnitrile compounds, and benzophenone compounds.

If the toner of an aspect of the present invention is produced in a wet production method such as an aggregation coalescence method described later, a dispersion dispersed with microcapsules and a dispersion dispersed with a photocurable composition are prepared. Examples of a solvent used for preparing these dispersions include a sole substance of water; alcohol such as, methanol, ethanol, n-propanol, isopropanol, n-butanol, sec-butanol, methylcellosolve, and 1-methoxy-2-propanol; halogen solvents such as methylene chloride and ethylene chloride; ketones such as acetone, cyclohexanone, and methylethylketone; esters such as methylcellosolve acetate, ethyl acetate, and methyl acetate; toluene and xylene, or a mixture of two or more types thereof. Among these, water is particularly preferred.

—Others—

Other than the materials described above, regarding a binder resin, a releasing agent, and other additives used for the photo-induced color forming toner, similar ones to the abovementioned non-photo-induced color forming toner may be used. Moreover, the toner particle size and the shape may be also similar to those of the non-photo-induced color forming toner.

Furthermore, materials described for the photo-induced color forming toner may be used for the non-photo-induced color forming toner unless the color forming property and the color formation control are negatively affected. Moreover, materials described for the non-photo-induced color forming toner may be also used for the photo-induced color forming toner.

(Toner Production Method)

Next is a detailed description of the toner production method.

The toner used for an aspect of the present invention may be produced using a publicly known wet production method such as an aggregation coalescence method. The wet production method is particularly suitable in the case where the toner has a structure of forming a color using substance dispersion at the time of heating at least (for example, the case where the abovementioned two or more types of reactive components are contained in different matrixes). Moreover, if the wet production method is used, the maximum process temperature for forming the toner can be kept low. Therefore color formation during the toner production process can be readily prevented.

From the viewpoint of preventing the color formation during the toner production process, the maximum process temperature when using the wet production method is preferably 90° C. or less, and more preferably 80° C. or less. However, if the process temperature is too low, the toner itself can be hardly produced. Therefore the maximum process temperature is preferably 40° C. or more.

Moreover, the wet production method is suitably used particularly for producing a toner having a structure containing a first component and a second component that form a color when they are reacted with each other, and a photocurable composition, and a microcapsule dispersed in the photocurable composition, wherein the first component is contained in the microcapsule and the second component is contained in the photocurable composition.

The microcapsule used for the toner having the above structure may be a heat responsive microcapsule. However, it may be a microcapsule which is responsive to light or other stimulations.

A publicly known wet production method may be used for producing the toner. However, among the wet production methods, an aggregation coalescence method is particularly preferably used since the maximum process temperature can be kept low, and a toner having various structures as shown in FIG. 6 and FIG. 7 may be readily produced.

Moreover, compared to a conventional toner having a pigment or a binder resin as the main component, the toner having the above structure contains a lot of photocurable composition which contains a low molecular component as the main component. Therefore, although the strength of particles obtained during the toner granulation process tends to be insufficient, the aggregation coalescence method does not require a large shearing force, and therefore the aggregation coalescence method is suitably used from this point.

Next is a more detailed description of the toner production method using the aggregation coalescence method. Generally, the aggregation coalescence method includes: an aggregation step for preparing dispersions of respective materials constituting the toner, and then forming aggregated particles in a raw material dispersion having a plurality of dispersions mixed; a fusion step for fusing the aggregated particles formed in the raw material dispersion; and as required, an adhesion step (coating layer formation step) between the aggregation step and the fusion step, for adhering a component for forming the coating layer on the surface of the aggregated particles, so as to form the coating layer.

Also in the production of the toner used for an aspect of the present invention, although the type and the combination of various dispersions used as a raw material differ, the toner can be produced by appropriately combining the adhesion step as required, in addition to the aggregation step and the fusion step.

Hereunder is a more detailed description of the production method using an aggregation coalescence method for the toner having the color forming part dispersion structure as shown in FIG. 6, or the toner having the concentric circle structure as shown in FIG. 7.

A. Production Method for a Toner Having the Color Forming Part Dispersion Structure First is a description of the production method using an aggregation coalescence method for the toner having the color forming part dispersion structure.

In this case, firstly one type or more of photosensitive/thermosensitive capsule dispersions capable of forming different colors from each other, are prepared, by going through: (a1) a first aggregation step for forming first aggregated particles in a raw material dispersion containing a microcapsule dispersed with a microcapsule containing a first component, and a photocurable composition dispersion dispersed with a photocurable composition containing a second component; (b1) an adhesion step for adding a first resin particle dispersion dispersed with resin particles in the raw material dispersion where the first aggregated particles are formed, so as to adhere the resin particles onto the surface of the aggregated particles; and (c1) a first fusion step for heating the raw material dispersion containing the aggregated particles having the resin particles adhered on the surface, to fuse, so as to obtain first fused particles (photosensitive/thermosensitive capsules).

Next, a toner having a color forming part dispersion structure can be obtained, by going through: (d1) a second aggregation step for forming second aggregated particles in a mixed liquid having the one type or more of photosensitive/thermosensitive capsule dispersions and the resin particles dispersed therein; and (e1) a second fusion step for heating the mixed liquid containing the second aggregated particles, to obtain second fused particles.

Two or more types of the photosensitive/thermosensitive capsule dispersions may be used for the second aggregation step. Moreover, the photosensitive/thermosensitive capsules obtained by going through the (a1) to (c1) steps may be used as a toner (that is, a toner containing only one color forming part), as it is.

—Preparation of Various Dispersions—

Hereunder is a description of the preparation method of various dispersions used for the toner production method utilizing the abovementioned aggregation coalescence method.

The resin particle dispersion is prepared by dispersing resin particles that have been produced by emulsion polymerization or the like, in a solvent, using an ionic surfactant. Alternatively, it is prepared by dissolving a resin in a soluble solvent by a phase inversion emulsion. Examples of the dispersion medium in the resin particle dispersion include an aqueous medium and an organic solvent.

Moreover, the releasing agent dispersion is prepared by dispersing a releasing agent in water together with an ionic surfactant or a polyelectrolyte such as a polymer acid or a polymer base, heating to a melting point or more, and particulating by a device capable of applying a strong shearing force.

Examples of the device for particulating by the above mechanical means include a Manton-Gaulin high pressure homogenizer (manufactured by GAULIN), a continuous ultrasonic homogenizer (manufactured by Nippon Seiki Co., Ltd.), a NANOMIZER (manufactured by Nanomizer),a MICRO FLUIDIZER (manufactured by Mizuho-Kogyo Co., Ltd.), a barrel type homogenizer, a SLASHER (manufactured by Mitsui Mining Co., Ltd.), and a CAVITRON (manufactured by EUROTEC LTD).

As the microcapsule dispersion, there is used an emulsified liquid having the microcapsule produced by using the various microcapsulization methods described above, dispersed in a solution containing a water soluble binder and the like.

Moreover, the photocurable composition dispersion can be obtained by mixing various components constituting the photocurable composition, such as a resin component such as a water soluble binder, or a solvent component such as water, with a surfactant or the like, and then particulating by a device capable of applying a strong shearing force.

The particle diameter of the particles contained in the various dispersions except for the microcapsule dispersion is preferably 1 μm or less, and more preferably within a range between 100 and 300 nm, so as to facilitate adjusting the toner diameter and the particle distribution to desired values.

—(a1) First Aggregation Step—

In the first aggregation step, first aggregated particles are formed in a raw material dispersion containing a microcapsule dispersed with a microcapsule containing a first component, and a photocurable composition dispersion dispersed with a photocurable composition containing a second component.

The temperature of heating is from room temperature to 40° C., and may be increased to about 60° C. as required.

The aggregated particles are formed by adding the coagulating agent at room temperature under aggregation by means of a rotary shear homogenizer or the like, and making the pH of the raw material dispersion acidic (pH=about 2 to 4).

For the coagulating agent used for the first aggregation step, there may be suitably used a surfactant having a reversed polarity to the surfactant used as the dispersing agent to be added into the raw material dispersion, that is, an inorganic metal salt or a multivalent metal complex. In particular, a metal complex is preferably used since the dosage of the surfactant can be reduced and the charging property is improved.

—(b1) Adhesion Step—

In the adhesion step, a first resin particle dispersion dispersed with resin particles is added in the raw material dispersion where the first aggregated particles are formed, so as to adhere the resin particles onto the surface of the aggregated particles. By so doing, the coating layer corresponding to the shell part of the photosensitive/thermosensitive capsule can be formed.

The coating layer can be formed by additionally adding the first resin particle dispersion into the dispersion where the aggregated particles (core particles) have been formed in the aggregation step. The binder resin component used for the first resin particle dispersion may be either crystalline or amorphous resin. The releasing agent dispersion may be used together with the first resin particle dispersion. Moreover, the releasing agent dispersion may be used instead of the first resin particle dispersion.

A surfactant may be used for emulsion polymerization of the binder resin, dispersion of various particle components, aggregation of particles, stabilization of the aggregated particles, and the like. Specifically, it is also effective to use: an anionic surfactant such as sulfate ester, sulfonate ester, phosphate ester, and soap; a cationic surfactant such as amine salt and quaternary ammonium salt; and nonionic surfactant such as polyethylene glycol, alkylphenol ethylene oxide adduct, and polyhydric alcohol, together. As the dispersion device, there may be used a general type such as a rotary shear homogenizer, a ball mill, a sand mill, and a dyno mill having a media.

—(c1) First Fusion Step—

In the first fusion step, the raw material dispersion containing the aggregated particles having the resin particles adhered on the surface, is heated to fuse, so as to obtain first fused particles (photosensitive/thermosensitive capsules).

In the first fusion step, the pH of the suspension containing the aggregated particles obtained by going through the first aggregation step and the adhesion step, is made within a range between about 6.5 and 8.5, so as to stop the progress of aggregation, and then heating is performed to fuse the aggregated particles.

Heating is performed at a temperature not lower than the glass-transition temperature or the melting point of the binder resin (and/or the releasing agent) used for forming the coating layer.

The heating temperature is set to a degree of melting the materials constituting the shell of the microcapsule but not eliminating the shell structure, and is generally determined by considering the heat resistance of the materials constituting the shell of the microcapsule and the temperature capable of fusing the materials forming the shell of the photosensitive/thermosensitive capsule, and is generally preferably within a range between 40 to 90° C., and more preferably within a range between 50 to 80° C.

If the heating temperature exceeds 90° C., the shell of the microcapsule may be eliminated and a color formed. Moreover, if it is less than 40° C., sufficient fusion may not be performed, and the photosensitive/thermosensitive capsule particles may be decomposed.

—(d1) Second Aggregation Step—

The above steps of (a1) to (c1) are performed by each type of the photosensitive/thermosensitive capsules (color capable of formation) to be dispersed into the toner, and a plurality of photosensitive/thermosensitive capsule dispersions capable of forming different colors from each other are prepared.

Next, in the second aggregation step, second aggregated particles are formed in a mixed solution having twp or more types of photosensitive/thermosensitive capsule dispersions and the resin particles dispersed therein. The mixed solution may be added with a releasing agent dispersion and a dispersion of other components, as required.

The second aggregation step is performed basically in the same manner as that of the first aggregation step, except that the composition of the solution used for aggregation is different. That is, the mixed dispersion is added with the coagulating agent, and then heated, so as to aggregate the photosensitive/thermosensitive capsule particles and the resin particles in the mixture, to form the second aggregated particles. During the process of forming the second aggregated particles, or after forming them, preferably the resin particle dispersion having amorphous resin particles dispersed, is additionally added, so as to coat the surface of the second aggregated particles with the amorphous resin particles.

The heating temperature may be the temperature capable of fusing the amorphous resin particles with each other, or with other materials. Specifically, the temperature may be several to several dozen degrees higher than the glass-transition temperature of the amorphous resin particles.

—(e1) Second Fusion Step—

In the second fusion step, the mixed solution containing the second aggregated particles, is heated to obtain second fused particles (wet toner).

In the second fusion step, the pH of the suspension containing the aggregated particles obtained by going through the second aggregation step, is made within a range between about 6.5 and 8.5, so as to stop the progress of aggregation, and then heating is performed to fuse the aggregated particles.

Heating is performed at a temperature not lower than the glass-transition temperature or the melting point of the binder resin used for forming the second aggregated particles.

The heating temperature is determined by considering the heat resistance of the materials constituting the shell of the microcapsule, the heat resistance of the materials constituting the shell of the photosensitive/thermosensitive capsule, and the temperature capable of fusing the binder resin used for forming the second aggregated particles, and is generally preferably within a range between 40 to 90° C., and more preferably within a range between 50 to 70° C.

If the heating temperature exceeds 90° C., the shell of the microcapsule may be eliminated and a color formed, the second component dispersed in the photosensitive/thermosensitive capsule capable of forming one color may be diffused outside of the photosensitive/thermosensitive capsule, and furthermore may be diffused outside of the photosensitive/thermosensitive capsule capable of forming another color, and sufficient color formation may not be obtained at the time of image formation.

Moreover, if the heating temperature is less than 40° C., sufficient fusion may not be performed, and the toner particles may be decomposed during the following steps such as cleaning/drying.

—Cleaning, Drying Step, and the Like—

After the second fusion step, desired toner particles are obtained by going through an optional cleaning step, a solid-liquid separation step, and a drying step. In the cleaning step, desirably washing is sufficiently performed with ion exchanged water, considering the charging property. Moreover, the solid-liquid separation step is not specifically limited, however suitably this is a suction filtration, a pressure filtration, or the like, from the point of productivity. Furthermore, the drying step is not particularly limited, however freeze drying, flash jet drying, fluidized drying, oscillatory fluidized drying, and the like are preferably used, from the point of productivity. Moreover, the dried toner particles may be added with the abovementioned various external additives as required.

B. Production Method for a Toner Having the Concentric Circle Structure

Next is a description of the production method using an aggregation coalescence method for the toner having the concentric circle structure.

In this case, firstly the photosensitive/thermosensitive capsule dispersions are prepared, by going through: (a2) a first aggregation step for forming first aggregated particles in a raw material dispersion containing a microcapsule dispersed with a microcapsule containing a first component, and a first photocurable composition dispersion dispersed with a photocurable composition containing a second component; (b2) an adhesion step for adding a first resin particle dispersion dispersed with resin particles in the raw material dispersion where the aggregated particles are formed, so as to adhere the resin particles onto the surface of the aggregated particles; and (c2) a first fusion step for heating the raw material dispersion containing the aggregated particles having the resin particles adhered on the surface, to fuse, so as to obtain photosensitive/thermosensitive capsules.

Next, a toner having a concentric circle structure can be obtained, by going through: (d2) a photosensitive/thermosensitive layer formation step for adding the raw material dispersion containing a second microcapsule dispersion dispersed with a microcapsule containing a first component, and a second photocurable composition dispersion dispersed with a photocurable composition containing a second component, into the photosensitive/thermosensitive capsule dispersion, so as to form a photosensitive/thermosensitive layer capable of forming different colors from the photosensitive/thermosensitive capsule, on the surface of the photosensitive/thermosensitive capsule; (e2) a coating layer formation step for adding the second resin particle dispersion dispersed with the resin particles into the raw material dispersion after the photosensitive/thermosensitive layer formation step, so as to adhere the resin particles on the surface of the photosensitive/thermosensitive layer, so as to form the coating layer; and (f2) a second fusion step for adhering the resin particles on the surface of the photosensitive/thermosensitive layer, and heating the raw material dispersion containing the second aggregated particles formed with the coating layer, so as to obtain fused particles.

If a toner having a concentric circle structure including three types of color forming parts or more capable of forming different colors from each other is produced, the process of sequentially performing the (d2) photosensitive/thermosensitive layer formation step, the (e2) coating layer formation step, and the (f2) second fusion step, is again repeated one or more times. By so doing, two or more photosensitive/thermosensitive layers and photosensitive/thermosensitive capsules formed through the respective photosensitive/thermosensitive layer formation steps can form different colors from each other.

Moreover, in the respective steps, a dispersion containing another component may be used together as required. For example, a releasing agent dispersion may be used in the first aggregation step, the adhesion step, the photosensitive/thermosensitive layer formation step, and the coating layer formation step.

Next is a more detailed description of the respective steps. Firstly, the preparation methods of various dispersions used for the respective steps are similar to the case where the toner having the photosensitive/thermosensitive capsule dispersion structure is produced.

Moreover, the steps (a2) to (c2) can be performed basically in the same manner as the abovementioned steps (a1) to (c1). However, there is only one type of the photosensitive/thermosensitive capsule dispersion prepared through the steps (a2) to (c2).

The (d2) photosensitive/thermosensitive layer formation step and the (e2) coating layer formation step performed next, are performed in the same manner as the above steps shown in (a1) and (b1), except that the photosensitive/thermosensitive layer and the coating layer are sequentially formed on the photosensitive/thermosensitive capsule particles serving as the core layer (core particle). By so doing, there is obtained a second aggregated particle having the photosensitive/thermosensitive capsule particle as a core layer, and the photosensitive/thermosensitive layer and the coating layer sequentially laminated over the core layer.

The coating layer formed in the (e2) coating layer formation step is to constitute a surface layer coating on the toner surface, when finally a toner is made, or an interlayer provided between two adjacent photosensitive/thermosensitive layers. Here, if this coating layer constitutes the surface layer when a toner is made, a resin particle dispersion using an amorphous resin is particularly preferably used in the (e2) coating layer formation step.

The (f2) second fusion step may be performed in the same manner as the above step shown in (e1). The heating temperature in the second fusion step is determined by considering the heat resistance of the materials constituting the shell of the microcapsule, the heat resistance of the materials constituting the shell of the photosensitive/thermosensitive capsule, and the heat resistance of the materials constituting the interlayer (if (d2) to (f2) are repeatedly performed two or more times), and the temperature capable of fusing the binder resin used for forming the second aggregated particles, and is generally preferably within a range between 40 to 90° C., and more preferably within a range between 50 to 80° C.

If the heating temperature exceeds 90° C., the shell of the microcapsule may be eliminated and a color formed, the second component dispersed in the color forming part (photosensitive/thermosensitive capsule and/or photosensitive/thermosensitive layer) capable of forming one color may be diffused outside of the color forming part (photosensitive/thermosensitive capsule and/or photosensitive/thermosensitive layer), and furthermore may be diffused outside of the color forming part (photosensitive/thermosensitive capsule and/or photosensitive/thermosensitive layer) capable of forming another color, and sufficient color formation may not be obtained at the time of image formation.

Moreover, if the heating temperature is less than 40° C., sufficient fusion may not be performed, and the toner particles may be decomposed during the following steps such as cleaning/drying.

After the series of steps described above, the toner may be obtained by going through a cleaning step, drying step, and the like, in the same manner as the above.

The volume average particle size of the microcapsule of the toner used for an aspect of the present invention is not specifically limited, and may be appropriately adjusted according to the toner structure, and the type/number of the color forming parts contained in the toner.

However, if the types of the color forming parts capable of forming different colors from each other, contained in the toner, are two to four (for example, the case where the toner contains three types of color forming parts capable of respectively forming yellow, cyan, and magenta), then the volume average particle size according to the respective toner structures may be within the following range.

That is, if the toner structure shown in FIG. 6 is a color forming part dispersion structure, the volume average particle size of the toner is preferably within a range between 5 to 40 μm, and more preferably within a range between 10 and 20 μm. Moreover, the volume average particle size of the photosensitive/thermosensitive capsule contained in the toner of a photosensitive/thermosensitive capsule dispersion structure having such a particle size, is preferably within a range between 1 to 5 μm, and more preferably within a range between 1 and 3 μm.

If the volume average particle size is less than 5 μm, the amount of the color forming component contained in the toner becomes less. Therefore the color reproducibility may be worsened, and the image density may be decreased. Moreover, if the volume average particle size exceeds 40 μm, irregularity on the image surface becomes greater. Therefore the image surface may be unevenly glossy, and the image quality may be decreased.

In the toner of a photosensitive/thermosensitive capsule dispersion structure having multiple photosensitive/thermosensitive capsules dispersed therein, the particle size is prone to be greater than a conventional toner having a small diameter (the volume average particle size is about 5 to 10 μm) using a colorant. However, the image definition is determined not by the particle size of the toner, but by the particle size of the photosensitive/thermosensitive capsule. Therefore a higher definition image may be obtained. In addition, since the powder fluidity is also superior, a sufficient fluidity may be maintained even if the amount of external additives is less, and the developability and the cleaning property may be improved.

If the toner structure has a concentric circle structure, a stripe structure, or a fan structure as shown in FIG. 7 to FIG. 9, the diameter may be readily reduced since the particulation of the photosensitive/thermosensitive capsule does not need to be considered compared to the toner of a photosensitive/thermosensitive capsule dispersion structure. The volume average particle size of this toner is preferably within a range between 3 and 40 μm, and more preferably within a range between 5 and 15 μm. If the volume average particle size is less than 3 μm, the toner itself may be hardly produced. Moreover, if the volume average particle size exceeds 40 μm, irregularity on the image surface becomes greater. Therefore the image surface may be unevenly glossy, and the image quality may be decreased.

Moreover, in the toner of an aspect of the present invention, preferably the volume average particle size distribution index GSDv is 1.30 or less, and the ratio of the volume average particle size distribution index GSDv to the number average particle size distribution index GSDp (GSDv/GSDp) is 0.95 or more.

More preferably, the volume average particle size distribution index GSDv is 1.25 or less, and the ratio of the volume average particle size distribution index GSDv to the number average particle size distribution index GSDp (GSDv/GSDp) is 0.97 or more.

If the volume average particle size distribution index GSDv exceeds 1.30, the image resolution may be decreased. Moreover, if the ratio of the volume average particle size distribution index GSDv to the number average particle size distribution index GSDp (GSDv/GSDp) is less than 0.95, the charging property of the toner is decreased and toner dispersion or fogging occurs, and image defects may be caused.

In an aspect of the present invention, values of the volume average particle size, the volume average particle size distribution index GSDv, and the number average particle size distribution index GSDp of the toner are measured and calculated as follows.

Firstly, a particle size distribution of the toner measured using a measuring instrument such as a COULTER MULTISIZER II (manufactured by Beckman Coulter, Inc.), is divided into particle size ranges (channels), and accumulated distributions of the volume and the number of the respective toner particles are drawn for the channels. The particle diameter providing an accumulation of 16% is defined as the volume average particle diameter D16v and the number average particle diameter D16p. The particle diameter providing an accumulation of 50% is defined as the volume average particle diameter D50v and the number average particle diameter D50p. Similarly, the particle diameter providing an accumulation of 84% is defined as the volume average particle diameter D84v and the number average particle diameter D84p. At this time, the volume average particle size distribution index (GSDv) is defined as $(D84v/D16v)^{1/2}$, and the number average particle size index (GSDp) is defined as $(D84p/D16p)^{1/2}$. Using these relational expressions, the volume average particle size distribution index (GSDv) and the number average particle size index (GSDp) can be calculated.

Moreover, the volume average particle size of the microcapsule or the photosensitive/thermosensitive capsule may be measured using for example a laser diffraction particle size distribution analyzer (LA-700 manufactured by Horiba Instruments Incorporated).

Moreover, the toner of an aspect of the present invention has a shape factor SF1 expressed by the following equation within a range between 110 and 130.

$$SF1=(ML^2/A)\times(\pi/4)\times100 \quad \text{equation (2)}$$

In the above equation (2), ML denotes a maximum length of the toner (μm) and A denotes a projected area of the toner ($\mu m^2$).

If the shape factor SF1 is less than 110, in the transfer step at the time of image formation, the toner easily remains on the image holding member surface, and therefore this remaining toner needs to be removed. However, the cleaning property for cleaning the remaining toner by means of a blade or the like is easily damaged, and as a result image defects may occur.

On the other hand, if the shape factor SF1 exceeds 130, when the toner is used as the developing agent, the toner may be broken due to collision with the carrier in the developing device. At this time, as a result, fine powder may be increased, and thereby the image holding member surface or the like is contaminated due to the releasing agent component exposed to the toner surface, which may cause a damage to the charging property, and problems such as fogging due to the fine powder.

The shape factor SF1 was measured using a LUZEX image analyzer (manufactured by Nireco Corporation, FT), as follows. Firstly, an optical micrograph of the toner scattered on a slide glass is imported to a Luzex image analyzer through a video camera, and the maximum length (ML) and the projected area (A) are measured for 50 or more toner particles. A square of maximum length and a projected area are calculated for the respective toner particles, and the shape factor SF1 is obtained from the above equation (2).

In order to apply fluidity and improve the cleaning property, similarly to the normal toner, after drying, inorganic particles such as silica, alumina, titania, and calcium carbonate, and resin particles such as a vinyl resin, polyester, and silicone may be added to the toner surface as a fluidity auxiliary or a cleaning auxiliary, by shearing in a dry state.

Examples of inorganic oxide particles to be added into the toner include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$. Among these, silica particles and titania particles are particularly preferable. The surface of the inorganic oxide particles is desirably subjected to a hydrophobic-treatment in advance. This hydrophobic-treatment improves the powder fluidity of the toner, and is effective for the environment dependency of the charging, and the carrier contamination resistance.

<Developing Agent>

The toner used for an aspect of the present invention may be used as a one component developing agent as it is, however in an aspect of the present invention it is preferably used as a two component developing agent including a carrier and the toner.

Here, from the point of being capable of forming the color image with one type of developing agent, the developing agent may be a type of: (1) a developing agent having one type of toner having two or more color forming parts containing the photocurable composition and the microcapsule dispersed in the photocurable composition, wherein the two or more color forming parts contained in the toner are capable of forming different colors from each other; or (2) a developing agent having two or more types of toners having one color forming part containing the photocurable composition and the microcapsule dispersed in the photocurable composition, wherein the color forming parts contained in the two or more types of toners are capable of forming different colors from each other.

For example, the developing agent of the former type may contain three types of color forming parts, wherein the three types of color forming parts include a yellow color forming part capable of forming yellow, a magenta color forming part capable of forming magenta, and a cyan color forming part capable of forming cyan. The developing agent of the latter type may contain a yellow color forming toner containing a color forming part capable of forming yellow, a magenta color forming toner containing a color forming part capable of forming magenta, and a cyan color forming toner containing a color forming part capable of forming cyan are mixed.

The carrier that can be used for the two component developing agent may include a resin covered over the surface of a core. The material of the core of the carrier is not specifically limited as long as the above condition is satisfied. Examples thereof include: magnetic metals such as iron, copper, nickel, and cobalt; alloys made from these and manganese, chromium, rare earths, or the like; and magnetic oxides such as ferrite and magnetite. From the viewpoint of core surface nature and the core resistance, preferred are ferrite, in particular, alloys with manganese, lithium, strontium, magnesium, or the like.

Moreover, the resin covering the core surface is not limited as long as it can be used as a matrix resin, and appropriately selected according to the purpose.

The mixing ratio (mass ratio) of the toner of an aspect of the present invention and the carrier in the two component developing agent, is preferably within a range of about toner: carrier=1:100 to 30:100, and more preferably within a range of about 3:100 to 20:100.

EXAMPLES

Hereunder is a more specific description of an aspect of the present invention with reference to examples. However, an aspect of the present invention is not limited to the following examples. "Part" and "%" in the following examples represent respectively "mass part" and "mass %".

<Production of Toner>

First is a description of the toner used in the following examples. In the following production of the toner, the preparation of the photocurable composition dispersions and production of a series of toners using them are all performed in the dark.

A. Non-Photo-Induced Color Forming Toner (Preparation of Microcapsule Dispersion)

—Microcapsule Dispersion (1)—

8.9 parts of an electron donating colorless dye capable of developing yellow (1) is dissolved in 16.9 parts of ethyl acetate, followed by adding 20 parts of a capsule wall material (trade name: TAKENATE D-110N, manufactured by Takeda Chemical Industries, Ltd.) and 2 parts of a capsule wall material (trade name: MILLIONATE MR200, manufactured by Nippon Polyurethane Industry Co., Ltd.).

The obtained solution is added to a mixed solution of 42 parts of 8% phthalated gelatin and 14 parts of water and 1.4 parts of 10% sodium dodecylbenzene sulphonate solution, followed by emulsifying and dispersing at 20° C., whereby an emulsified liquid is obtained. Next, the obtained emulsified liquid is added with 72 parts of a 2.9% tetraethylenepentamine aqueous solution, followed by heating to 60° C. under stirring, and after two hours elapsed, a microcapsule dispersion (1) that had the electron donating colorless dye (1) in the core and an average particle diameter of 0.5 μm is obtained.

The glass-transition temperature of the material constituting the shell of the microcapsule contained in this microcapsule dispersion (1) (material obtained by the reaction of TAKENATE D-110N and MILLIONATE MR200 in approximately same condition as the above), is 100° C.

—Microcapsule Dispersion (2)—

The microcapsule dispersion (2) is obtained in the same manner as the case of preparing the microcapsule dispersion (1), except that the electron donating colorless dye (1) is changed into the electron donating colorless dye (2). The average particle diameter of the microcapsule in this dispersion is 0.5 μm.

—Microcapsule Dispersion (3)—

The microcapsule dispersion (3) is obtained in the same manner as the case of preparing the microcapsule dispersion (1), except that the electron donating colorless dye (1) is changed into the electron donating colorless dye (3). The average particle diameter of the microcapsule in this dispersion is 0.5 μm.

The formulae of the electron donating colorless dyes (1) to (3) used for preparing the microcapsule dispersion are shown below.

Electron donating colorless dye (1)

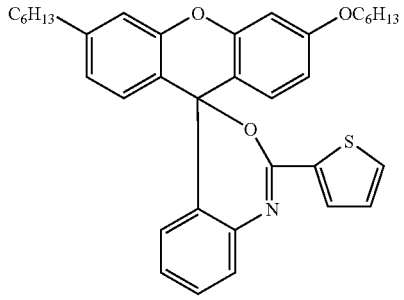

Electron donating colorless dye (2)

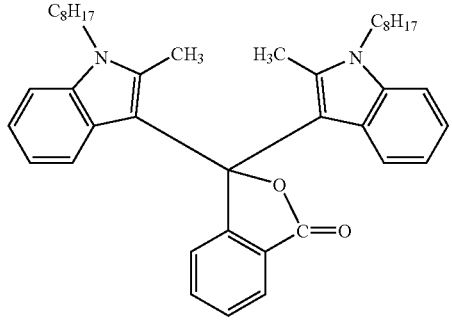

Electron donating colorless dye (3)

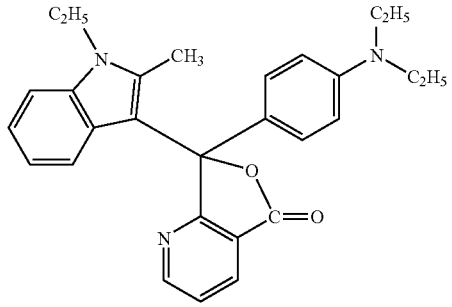

(Preparation of Photocurable Composition Dispersion)

—Photocurable Composition Dispersion (1)—

100.0 parts of a mixture of the electron accepting compounds (1) and (2) having polymerizable a group (mixing ratio 50:50) and 0.1 part of the thermal polymerization inhibitor (ALI) are dissolved in 125.0 parts of isopropyl acetate (water solubility: about 4.3%) at 42° C., to make a mixed solution I.

This mixed solution I is added with 18.0 parts of hexaarylbiimidazole (1) [2,2'-bis(2-chlorophenyl)-4,4',5,5'tetraphenyl-1,2'-biimidazole],0.5 part of a nonionic organic dye, and 6.0 parts of an organic boron compound, and dissolved at 42° C., to make a mixed solution II.

The mixed solution II is added to a mixed solution of 300.1 parts of 8% gelatin aqueous solution and 17.4 parts of 10% surfactant (1) aqueous solution, which is then emulsified using a homogenizer (manufactured by Nippon Seiki Co., Ltd.) at 10000 rpm for 5 minutes. Then, solvent removal is performed at 40° C. for 3 hours, to obtain a photocurable composition dispersion (1) having 30% solid content.

The formulae of the electron accepting compound (1) having a polymerizable group used for preparing the photocurable composition dispersion (1), the electron accepting compound (2) having a polymerizable group, the thermal polymerization inhibitor (ALI), the hexaarylbiimidazole (1), the surfactant (1), the nonionic organic dye, and the organic boron compound are shown below.

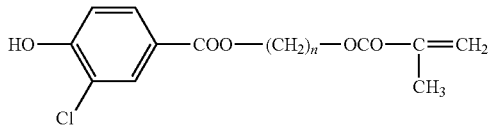

n = 5 (1)
n = 6 (2)

Polymerizable electron accepting compound

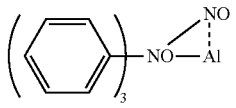

ALI

Surfactant (1)

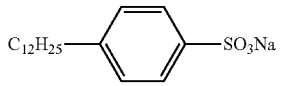

Hexaarylbiimidazole (1)

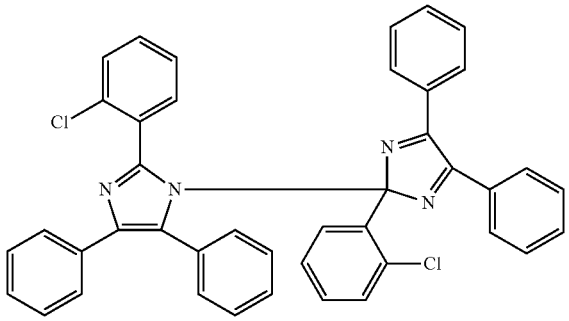

-continued

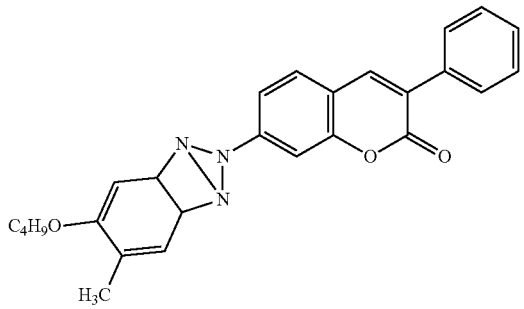

Noionic organic dye

-continued

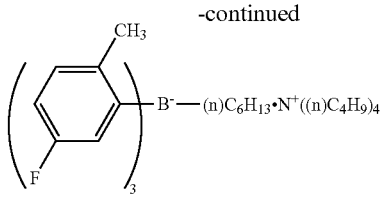

Organic boron compound

—Photocurable Composition Dispersion (2)—

A mixed solution of 0.6 parts of the following organic borate compound (I) (borate compound II), 0.1 parts of the following spectral sensitizing dye borate compound (I) (borate compound II), 0.1 parts of the following auxiliary (1) for increasing sensitivity, and 3 parts of isopropyl acetate (water solubility: about 4.3%) is added with 5 parts of the following electron accepting compound (3) having a polymerizable group.

Organic borate compound (I)

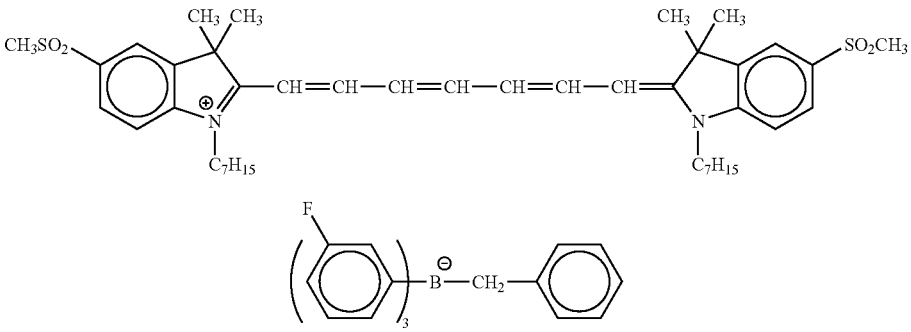

Spectral sensitizing dye borate compound (I)

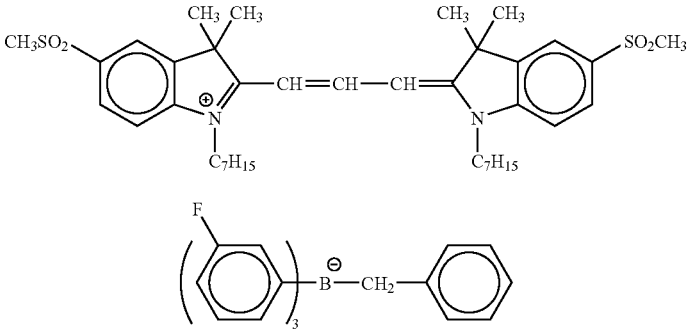

Spectral sensitizing dye borate compound (II)

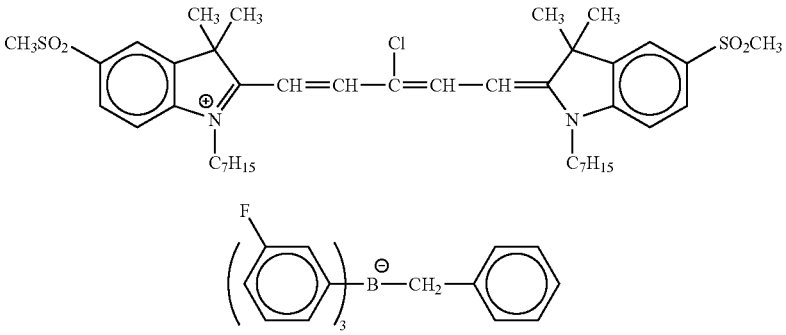

The obtained solution is added to a mixed solution of 13 parts of 13% gelatin aqueous solution, 0.8 part of the following 2% surfactant (2) aqueous solution, and 0.8 part of the following 2% surfactant (3) solution, which is then emulsified using a homogenizer (manufactured by Nippon Seiki Co., Ltd.) at 10000 rpm for 5 minutes, to obtain a photocurable composition dispersion (2).

The formulae of the electron accepting compound (3) having a polymerizable group used for preparing the photocurable composition dispersion (2), the auxiliary (1), the surfactant (2), and the surfactant (3) are shown below.

Electron accepting compound (3)

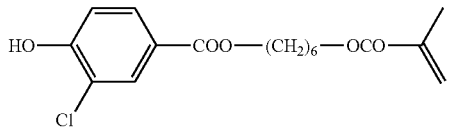

Auxiliary (1)

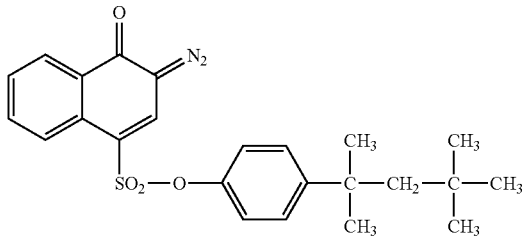

Surfactant (2)

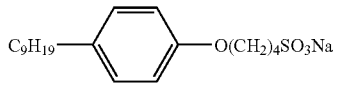

Surfactant (3)

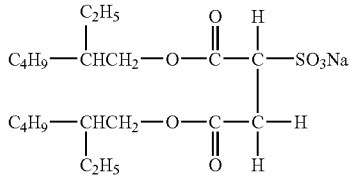

—Photocurable Composition Dispersion (3)—

The photocurable composition dispersion (3) is obtained in the same manner as the case of preparing the photocurable composition dispersion (2), except that 0.1 part of the above-mentioned spectral sensitizing dye borate compound (II) (borate compound II) is used instead of the spectral sensitizing dye borate compound (I).

(Preparation of Resin Particle Dispersion)

Styrene: 460 parts n butylacrylate: 140 parts

Acrylic acid: 12 parts

Dodecanethiol: 9 parts

The above components are mixed and dissolved, to prepare a solution. Next, 12 parts of an anionic surfactant (DOWFAX, produced by Rhodia, Inc.) is dissolved in 250 parts of ion exchanged water, which is then added with the above solution and dispersed in a flask, to prepare an emulsified liquid (monomer emulsified liquid A).

Moreover, 1 part of the anionic surfactant (DOWFAX, produced by Rhodia, Inc.) is dissolved in 555 parts of ion exchanged water, and poured into a polymerization flask. The polymerization flask is sealed and a reflux tube is equipped therewith. Under injection of nitrogen, the polymerization flask is heated to 75° C. on a water bath under slow stirring, and that condition is maintained.

Next, 9 parts of ammonium persulfate are dissolved in 43 parts of ion exchanged water, which is then added dropwise into the polymerization flask through a metering pump over 20 minutes. The monomer emulsified liquid A is then added dropwise through a metering pump over 200 minutes.

Then, the polymerization flask is maintained at 75° C. for 3 hours under slow stirring to complete polymerization.

As a result, a resin fine particle dispersion having particle median diameter of 210 nm, a glass transition point of 51.5° C., a weight average molecular weight of 31000, and a solid content of 42% is obtained.

(Production of Toner 1 (Color Forming Part Dispersion Structure))

—Preparation of Photosensitive/thermosensitive Capsule Dispersion (1)—

Microcapsule dispersion (1): 150 parts

Photocurable composition dispersion (1): 300 parts

Polyaluminum chloride: 0.20 parts

Ion exchanged water: 300 parts

The raw material solution having the above components mixed is added with nitric acid to adjust the pH to 3.5, and sufficiently mixed and dispersed by a homogenizer (ULTRA TURRAX T50, manufactured by IKA Works Inc.). It is then moved into a flask and heated to 40° C., under stirring by a three one motor in a heating oil bath, and the condition is maintained for 60 minutes. Furthermore, 300 parts of the resin particle dispersion is added and gently stirred at 60° C. for 2 hours. As a result, the photosensitive/thermosensitive capsule dispersion (1) is obtained.

The volume average particle size of the photosensitive/thermosensitive capsule dispersed in this dispersion is 3.53 μm. Moreover, at the time of preparing this dispersion, no spontaneous color formation of the dispersion is confirmed.

—Preparation of Photosensitive/thermosensitive Capsule Dispersion (2)—

Microcapsule dispersion (2): 150 parts

Photocurable composition dispersion (2): 300 parts

Polyaluminum chloride: 0.20 parts

Ion exchanged water: 300 parts

The photosensitive/thermosensitive capsule dispersion (2) is obtained in the same manner as the case of preparing the photosensitive/thermosensitive capsule dispersion (1), except that the above components are used as the raw material solution.

The volume average particle size of the photosensitive/thermosensitive capsule dispersed in this dispersion is 3.52 μm. Moreover, at the time of preparing this dispersion, no spontaneous color formation of the dispersion is confirmed.

—Preparation of Photosensitive/thermosensitive Capsule Dispersion (3)—

Microcapsule dispersion (3): 150 parts

Photocurable composition dispersion (3): 300 parts

Polyaluminum chloride: 0.20 parts

Ion exchanged water: 300 parts

The photosensitive/thermosensitive capsule dispersion (3) is obtained in the same manner as the case of preparing the photosensitive/thermosensitive capsule dispersion (1), except that the above components are used as the raw material solution.

The volume average particle size of the photosensitive/thermosensitive capsule dispersed in this dispersion is 3.47 μm. Moreover, at the time of preparing this dispersion, no spontaneous color formation of the dispersion is confirmed.

—Production of Toner—

Photosensitive/thermosensitive Capsule Dispersion (1): 750 parts

Photosensitive/thermosensitive Capsule Dispersion (2): 750 parts

Photosensitive/thermosensitive Capsule Dispersion (3): 750 parts

The solution mixed with the above components is moved into a flask. Under stirring the flask, a heating oil bath is heated to 42° C., and the condition is maintained for 60 minutes. Furthermore, 100 parts of the resin particle dispersion is added and gently stirred.

Then, the pH in the flask is adjusted to 5.0 with 0.5 mol/l sodium hydroxide solution, after which it is heated to 55° C., while stirring. During the temperature being increased up to 55° C., the pH in the flask is normally decreased to 5.0 or less. However, here, sodium hydroxide solution is additionally dripped to keep the pH at 4.5 or more. This condition is maintained at 55° C. for 3 hours.

After the reaction, it is cooled down, filtered, and sufficiently washed with an ion exchanged water, and is subjected to solid-liquid separation by Nutsche suction filtration. It is then again dispersed in 3 L of ion exchanged water at 40° C. in a 5 L beaker, followed by stirring and washing at 300 rpm for 15 minutes. This washing operation is repeated five times, and solid-liquid separation is carried out by Nutsche suction filtration. Then, vacuum freeze-drying is performed for 12 hours to obtain toner particles having the photosensitive/thermosensitive capsules dispersed in a styrene resin. The particle diameter of the toner particles is measured with a COULTER COUNTER. The volume average particle size D50v is 15.2 μm.

Next, 1.0 part of hydrophobic silica (TS720, produced by Cabot Corporation) is added to 50 parts of the toner particles and mixed in a sample mill to obtain an external toner 1.

(Production of Toner 2 (Concentric Circle Structure))

—Production of Toner—

Microcapsule dispersion (1): 150 parts

Photocurable composition dispersion (1): 300 parts

Polyaluminum chloride: 0.20 parts

Ion exchanged water: 300 parts

The raw material solution having the above components mixed is added with nitric acid to adjust the pH to 3.5, and sufficiently mixed and dispersed by a homogenizer (ULTRA TURRAX T50, manufactured by IKA Works Inc.). It is then moved into a flask and heated to 40° C., under stirring by a three one motor in a heating oil bath, and the condition is maintained for 60 minutes. Furthermore, 300 parts of the resin particle dispersion is added and gently stirred.

Then, the pH in the flask is adjusted to 7.5 with 0.5 mol/l sodium hydroxide solution, after which it is heated to 60° C., while stirring. It is then gently stirred at 60° C. for 2 hours. It is once taken out from the flask, left and cooled down, to obtain the photosensitive/thermosensitive capsule dispersion.

The volume average particle size of the photosensitive/thermosensitive capsule dispersed in this dispersion is 4.50 μm. Moreover, at the time of preparing this dispersion, no spontaneous color formation of the dispersion is confirmed.

Next, the photosensitive/thermosensitive capsule dispersion is added with the mixed solution of the following components, and the pH is adjusted with nitric acid to 3.5. It is sufficiently mixed and dispersed by a homogenizer (ULTRA TURRAX T50, manufactured by IKA Works Inc.).

Microcapsule dispersion (2): 150 parts

Photocurable composition dispersion (2): 300 parts

Polyaluminum chloride: 0.20 parts

Ion exchanged water: 300 parts

Next, the above mixed and dispersed solution is moved into a flask again, and heated to 40° C., under stirring by a three one motor in a heating oil bath, and the condition is maintained for 60 minutes. Furthermore, 200 parts of the resin particle dispersion is added and gently stirred.

Then, the pH in the flask is adjusted to 7.5 with 0.5 mol/l sodium hydroxide solution, after which it is heated to 60° C., while stirring. It is then gently stirred at 60° C. for 2 hours. It is once taken out from the flask, left and cooled down, to obtain the photosensitive/thermosensitive capsule dispersion.

The volume average particle size of the photosensitive/thermosensitive capsule dispersed in this dispersion is 6.0 μm. Moreover, at the time of preparing this dispersion, no spontaneous color formation of the dispersion is confirmed.

Next, the photosensitive/thermosensitive capsule dispersion is added with the mixed solution of the following components, and the pH is adjusted with nitric acid to 3.5. It is sufficiently mixed and dispersed by a homogenizer (ULTRA TURRAX T50, manufactured by IKA Works Inc.).

Microcapsule dispersion (3): 150 parts

Photocurable composition dispersion (3): 300 parts

Polyaluminum chloride: 0.20 parts

Ion exchanged water: 300 parts

Next, the above mixed and dispersed solution is moved into a flask again, and heated to 40° C., under stirring by a three one motor in a heating oil bath, and the condition is maintained for 60 minutes. Furthermore, 100 parts of the resin particle dispersion is added and gently stirred at 60° C. for 2 hours.

Then, the pH in the flask is adjusted to 5.0 with 0.5 mol/l sodium hydroxide solution, after which it is heated to 55° C., while stirring. During the temperature being increased up to 55° C., the pH in the flask is normally decreased to 5.0 or less. However, here, sodium hydroxide solution is additionally dripped to keep the pH at 4.5 or more. This condition is maintained at 55° C. for 3 hours. At the time of preparing this dispersion, no spontaneous color formation of the dispersion is confirmed.

After the reaction, it is cooled down, filtered, and sufficiently washed with an ion exchanged water, and is subjected to solid-liquid separation by Nutsche suction filtration. It is then again dispersed in 3 L of ion exchanged water at 40° C., followed by stirring and washing at 300 rpm for 15 minutes. This washing operation is repeated five times, and solid-liquid separation is carried out by Nutsche suction filtration. Then, vacuum freeze-drying is performed for 12 hours to obtain toner particles.

The particle diameter of the toner particles is measured with a COULTER COUNTER. The volume average particle size D50v is 7.5 μm. 1.0 part of hydrophobic silica (TS720, produced by Cabot Corporation) is added to 50 parts of the toner particles and mixed in a sample mill to obtain an external toner 2.

B. Photo Color Forming Toner (Preparation of Microcapsule Dispersion)

—Microcapsule Dispersion (1)—

12.1 parts of an electron donating colorless dye (1) is dissolved in 10.2 parts of ethyl acetate, followed by adding 12.1 parts of dicyclohexylphthalate, 26 parts of TAKENATE D-110N (manufactured by Takeda Chemical Industries, Ltd.) and 2.9 parts of MILLIONATE MR200 (manufactured by Nippon Polyurethane Industry Co., Ltd.).

Next, this solution is added to a mixed solution of 5.5 parts of polyvinyl alcohol and 73 parts of water, followed by emulsifying and dispersing at 20° C., whereby an emulsified liquid having an average particle diameter of 0.5 μm is obtained. The obtained emulsified liquid is added with 80 parts of water, followed by heating to 60° C. under stirring, and after two hours had elapsed, a microcapsule dispersion (I) that had the electron donating colorless dye (1) in the core is obtained.

The glass-transition temperature of the material constituting the shell of the microcapsule contained in this microcapsule dispersion (1) (material obtained by the reaction of dicyclohexylphthalate, TAKENATE D-110N, and MILLIONATE MR200 in approximately the same condition as the above), is 130° C.

—Microcapsule Dispersion (2)—

The microcapsule dispersion (2) is obtained in the same manner as the case of preparing the microcapsule dispersion (1), except that the electron donating colorless dye (1) is changed into the electron donating colorless dye (2).

—Microcapsule Dispersion (3)—

The microcapsule dispersion (3) is obtained in the same manner as the case of preparing the microcapsule dispersion (1), except that the electron donating colorless dye (1) is changed into the electron donating colorless dye (3).

(Preparation of Photocurable Composition Dispersion)

—Photocurable Composition Dispersion (1)—

A solution having 1.62 parts of photopolymerization initiator (1-a) and 0.54 parts of photopolymerization initiator (1-b) dissolved in 4 parts of ethyl acetate is added with 9 parts of an electron accepting compound (1) and 7.5 parts of trimethylolpropane triacrylate monomer (trifunctional acrylate, molecular weight about 300).

The solution obtained in this manner is added into a mixed solution having 19 parts of 15% PVA (polyvinyl alcohol) solution, 5 parts of water, 0.8 part of 2% surfactant (1), and 0.8 parts of 2% surfactant (2), which is then emulsified using a homogenizer (manufactured by Nippon Seiki Co., Ltd.) at 8000 rpm for 7 minutes, to obtain a photocurable composition dispersion (1) as an emulsified liquid.

—Photocurable Composition Dispersion (2)—

The photocurable composition dispersion (2) is obtained in the same manner as the case of preparing the photocurable composition dispersion (1), except that the photopolymerization initiators (1-a) and (1-b) are changed into 0.08 parts of photopolymerization initiator (2-a), 0.18 parts of photopolymerization initiator (2-b), and 0.18 parts of photopolymerization initiator (2-c).

—Photocurable Composition Dispersion (3)—

The photocurable composition dispersion (3) is obtained in the same manner as the case of preparing the photocurable composition dispersion (1), except that the photopolymerization initiator (2-b) used in the photocurable composition dispersion (2) is changed into a photopolymerization initiator (3-b).

The formulae of the photopolymerization initiators (1-a), (1-b), (2-a), (2-b), (2-c), and (3-b), the electron accepting compound (1), and the surfactants (1) and (2) used for preparing the photocurable composition dispersion are shown below.

Photopolymerization initiator (1-a)

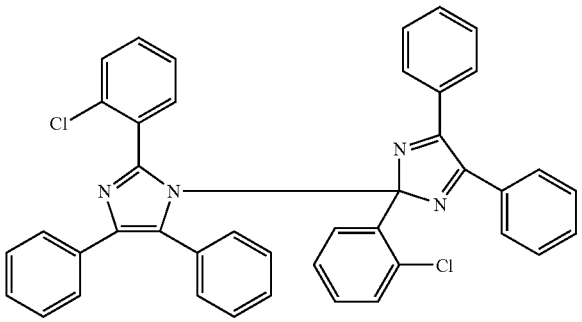

Photopolymerization initiator (1-b)

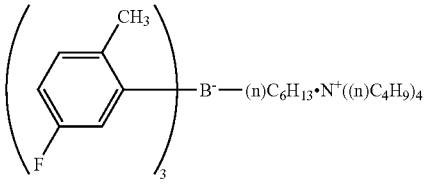

Photopolymerization initiator (2-a)

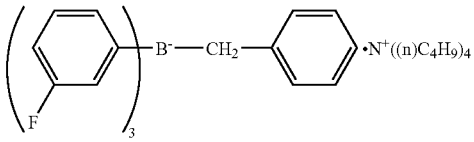

Photopolymerization initiator (2-b)

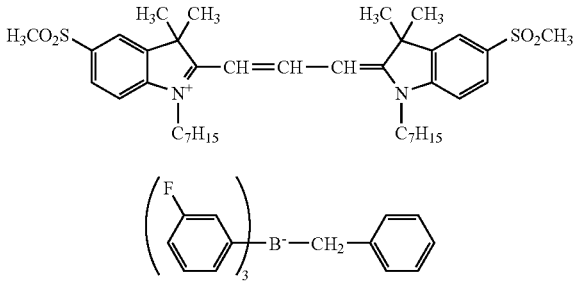

Photopolymerization initiator (2-c)

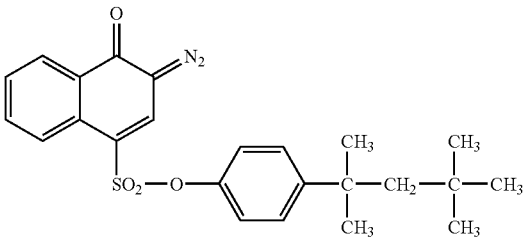

-continued

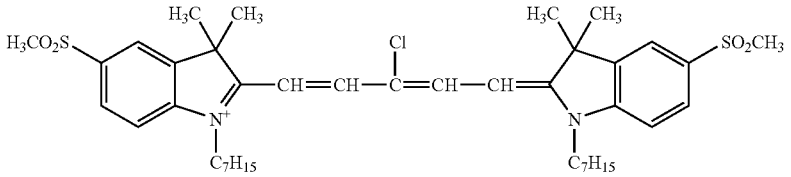

Photopolymerization initiator (3-b)

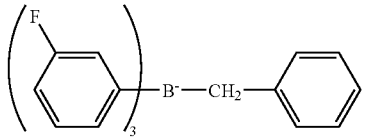

Electron accepting compound (1)

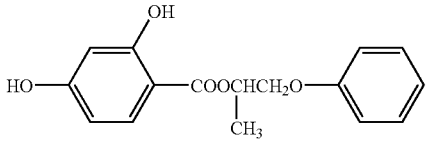

$C_{12}H_{25}SO_3Na$

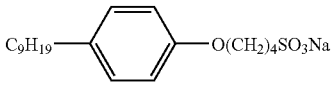

Surfactant (1)

Surfactant (2)

—Preparation of Resin Particle Dispersion (1)—

Styrene: 360 parts n butylacrylate: 40 parts

Acrylic acid: 4 parts

Dodecanethiol thiol: 24 parts

Carbon tetrabromide: 4 parts

A solution having the above compounds mixed and dissolved is dispersed and emulsified in a solution having 6 parts of nonionic surfactant (NONIPOL 400 manufactured by Sanyo Chemical Industries, Ltd.) and 10 parts of anionic surfactant (NEOGEN SC manufactured by Dai-Ichi Kogyo Seiyaku Col, Ltd.) dissolved in 560 parts of an ion exchanged water, in a flask. While slowly mixing for 10 minutes, 50 parts of ion exchanged water having 4 parts of ammonium persulfate dissolved is put thereinto.

Next, after replacing the interior of the flask with nitrogen, the solution in the flask is heated to 70° C. in an oil bath under stirring, and emulsion polymerization is continued for 5 hours, as it is. By so doing, there is obtained a resin particle dispersion (1) (resin particle concentration: 30%) dispersed with resin particles having a volume average particle size of 200 nm, a glass-transition temperature of 50° C., a weight average molecular weight (Mw) of 16200, and a specific gravity of 1.2.

—Preparation of Photosensitive/Thermosensitive Capsule Dispersion (1)—

Microcapsule dispersion (1): 24 parts

Photocurable composition dispersion (1): 232 parts

The above components are sufficiently mixed and dispersed by an ULTRA TURRAX T50 manufactured by IKA Works Inc, in a stainless round flask.

The pH is adjusted to 3 with nitric acid. Next, 0.20 part of polyaluminum chloride is added thereinto, and a dispersion operation is continued for 10 minutes at 6000 rpm, by the ULTRA TURRAX T50. The flask is heated to 40° C. in a heating oil bath under slow stirring.

Here, 60 parts of the resin particle dispersion (1) is gently added thereinto.

By so doing, the photosensitive/thermosensitive capsule dispersion (1) is obtained. The volume average particle size of the photosensitive/thermosensitive capsule dispersed in this dispersion is about 2 μm. Moreover, no spontaneous color formation of the obtained dispersion is confirmed.

—Preparation of Photosensitive/thermosensitive Capsule Dispersion (2)—

The photosensitive/thermosensitive capsule dispersion (2) is obtained in the same manner as the case of preparing the photosensitive/thermosensitive capsule dispersion (1), except that the microcapsule dispersion (1) is changed into a microcapsule dispersion (2) and the photocurable composition dispersion (1) is changed into a photocurable composition dispersion (2). The volume average particle size of the photosensitive/thermosensitive capsule dispersed in this dispersion is about 2 μm. Moreover, no spontaneous color formation of the obtained dispersion is confirmed.

—Preparation of Photosensitive/thermosensitive Capsule Dispersion (3)—

The photosensitive/thermosensitive capsule dispersion (3) is obtained in the same manner as the case of preparing the photosensitive/thermosensitive capsule dispersion (1), except that the microcapsule dispersion (1) is changed into a microcapsule dispersion (3) and the photocurable composition dispersion (1) is changed into a photocurable composition dispersion (3). The volume average particle size of the photosensitive/thermosensitive capsule dispersed in this dispersion is about 2 μm. Moreover, no spontaneous color formation of the obtained dispersion is confirmed.

(Production of Toner 3 (Color Forming Part Dispersion Structure))

—Production of Toner—

Photosensitive/thermosensitive capsule dispersion (1): 80 parts

Photosensitive/thermosensitive capsule dispersion (2): 80 parts

Photosensitive/thermosensitive capsule dispersion (3): 80 parts

Resin particle dispersion (1): 80 parts

The above components are sufficiently mixed and dispersed by an ULTRA TURRAX T50 manufactured by IKA Works Inc, in a stainless round flask.

Next, 0.1 part of polyaluminum chloride is added thereinto, and a dispersion operation is continued for 10 minutes at 6000 rpm, by the ULTRA TURRAX T50. The flask is heated to 48° C. in a heating oil bath under slow stirring. It is then maintained at 48° C. for 60 minutes, and added with 20 parts of the resin particle dispersion (1).

Then, the pH of the system is adjusted to 8.5 with 0.5 mol/l of sodium hydroxide solution. Then, the stainless flask is sealed and heated to 55° C., while stirring is continued using a magnetic seal. This condition is maintained for 10 hours.

After the reaction, it is cooled down, filtered, and sufficiently washed with an ion exchanged water, and is subjected to solid-liquid separation by Nutsche suction filtration. This is then again dispersed in 1 L of ion exchanged water at 40° C., followed by stirring and washing at 300 rpm for 15 minutes.

This is again repeated five more times. At the time when the filtrate had a pH of 7.5, and an electroconductivity of 7.0 μS/cmt, solid-liquid separation is carried out by Nutsche suction filtration using No. 5A filter paper. Then, vacuum drying is performed for 12 hours to obtain toner particles having a structure where three types of photosensitive/thermosensitive capsules are dispersed in the parent material.

The particle diameter at this time is measured with a COULTER COUNTER, and the volume average particle size D50v is about 15 μm. Moreover, no spontaneous color development of the obtained toner is confirmed.

Next, 100 parts of this toner (1), 0.3 part of hydrophobic titania the surface of which is treated with n-decyltrimethoxy silane, having an average particle size of 15 nm, and 0.4 part of hydrophobic silica (NY50 manufactured by Japan Aerogil Co., Ltd.) having an average particle size of 30 nm are blended using a HENSCHEL mixer at a peripheral speed of 32 m/s for 10 minutes. Then, coarse particles are removed using a sieve having an opening of 45 μm, to obtain an external toner 3 added with the external additive.

<Preparation of Developing Agent>

Next, using a ferrite carrier (dosage of polymethylmethaacrylate with respect to the gross weight of carrier: 1 mass %) having the surface of the carrier core covered with polymethylmethaacrylate (manufactured by Soken Kagaku) and having an average particle diameter of 50 μm, the external toners 1 to 3 are weighted so that the toner concentration became 5 mass %. These are then stirred and mixed in a ball mill for 5 minutes, to prepare the developing agents (1) to (3).

Example 1

Image Formation

The image forming apparatus as shown in FIG. 1 is prepared and the developing agent 1 is used as a developing agent.

As the photoreceptor 10, there is used an aluminum drum formed with a coating of a multilayer organic photosensitive layer comprising a charge generating layer containing gallium chloride phthalocyanine and a charge transporting layer of a thickness of 25 μm containing N,N'-diphenyl-N,N'-bis (3-methylphenyl)-[1,1']biphenyl-4,4'-diamine. Moreover, a scorotron is used as a charging unit 12.

As the exposure unit 14, there is used an LED image bar having a wavelength of 780 nm capable of forming a latent image having a definition of 600 dpi. The development unit 16 includes a metal sleeve for two component magnetic brush development, and is capable of reversal development. The charging amount of the toner for this developing device installed with the developing agent 1 is about −5 to −30 μC/g.

The color forming information applying unit 28 is an LED image bar capable of irradiating light having a peak wavelength of 405 nm (amount of exposed light: 0.2 mJ/cm$^2$), 532 nm (amount of exposed light: 0.2 mJ/cm$^2$), and 657 nm (amount of exposed light: 0.4 mJ/cm$^2$) and having a definition of 600 dpi. The transfer unit 18 had a semiconductive roller having the circumference of the semiconductive core covered with a semiconductive elastic body, as a transfer roller. The semiconductive elastic body comprised a non-soluble blended material mixed with NBR and EPDM, having two types of carbon blacks of ketjen black and thermal black dispersed therein, with a roller resistance of $10^{8.5}$ Ωcm and an Asker C hardness of 35.

For the fixing unit 22, there is used a fixing device used for a DPC1616 manufactured by Fuji Xerox Co., Ltd. It is arranged in a position 30 cm away from the point applied with the color forming information. Moreover, as the photo irradiation device 24, a high intensity Schaukasten having three wavelengths of the color forming information applying unit is used, and the irradiation width is 5 mm.

The printing conditions are set as below, by the image forming apparatus of the above structure.

Photoreceptor linear velocity: 10 mm/second

Charging condition: −400 V is applied to a scorotron screen, and DC of −6 kV is applied to a wire. The surface potential of the photoreceptor at that time is −400 V.

Light exposure: light is exposed by a logical OR operation of image formation for four colors of Y, M, C, and black. The potential after the light exposure is about −50V.

Developing bias: DC −330V is superimposed with rectangular waves of AC Vpp 1.2 kV (3 kHz)

Developing agent contact condition: peripheral speed ratio (development roller/photoreceptor) is set to 2.0, development gap is set to 0.5 mm, weight of the developing agent on the development roller is set to 400 g/m$^2$, so that the toner development amount on the photoreceptor becomes 5 g/m$^2$ in a solid image.

Transferring bias: DC+800V is applied.

Fixing temperature: fixing roller surface temperature is set to 180° C.

Photo irradiation unit illumination: 130000 lux.

From the above conditions, a chart having gradation image parts for each color of Y, M, C, R, G, B, and K is printed. The color forming information is applied to the toner, by combinations shown in Table 1 below (showing that the toner forms a desired color when an LED with "X" emits light). Moreover, since the light emission intensity or the light emission time controls the color density, there is employed a time duration modulation where time for 1 dot is divided into eight.

TABLE 1

| | | Color | | | | | | | |
|---|---|---|---|---|---|---|---|---|---|
| | | Y color | M color | C color | R color | G color | B color | K color | W color |
| LED wavelength | 405 nm | | X | X | | | X | | X |
| | 532 nm | X | | X | | X | | | X |
| | 657 nm | X | X | | X | | | | X |

(Image Evaluation)

Print samples obtained from the above conditions are evaluated as follows.

—Color Density—

The image density of the solid image parts for each color of Y, M, and C is measured by a density meter X-RITE 938 (manufactured by X-Rite), and it is confirmed that all of the colors are sufficiently developed with the image density of 1.5 or more.

—Color Reproducibility—

The color reproducibility of the solid image part for each color of R, G, B, Y, M, and C is measured by a gradation chart from 5% to 100% at intervals of 5%. All of the colors are excellent in the color balance, and the color reproducibility is superior.

—Highlight Image Part Reproducibility—

The reproducibility of the highlight image part is measured in a 15% halftone image on the whole surface of the print, and it is confirmed that the print is excellent without any splash of the highlight part.

Example 2

Image Formation is performed in the same manner as Image Formation of Example 1, except that the linear velocity of the photoreceptor is set to 300 mm/second, and the same Image Evaluation is performed. Moreover, in this condition, the fixing unit and the photo irradiation unit are taken out, and an unfixed image is output, which is left as it is for 10 minutes in the dark. Light is irradiated at the same velocity and the same temperature, to form an image.

As a result, the obtained print is not inferior to the print of Example 1, in color density, color reproducibility, and highlight image part reproducibility, whether it is left or not.

Example 3

Image Formation is performed in the same manner as Image Formation of Example 11, except that the developing agent 2 is used instead of the developing agent 1, and the same Image Evaluation is performed.

As a result, at least in the initial image, the color density is equivalent to that of Example 1. Furthermore, the color reproducibility and the highlight part reproducibility showed better evaluation results than those of Example 1 visually.

Example 4

Image Formation is performed in the same manner as Image Formation of Example 1, except that the developing agent 3 is used instead of the developing agent 1, and the color forming information is applied to the toner by the combinations shown in Table 2 below instead of those in Table 1, and the same Image Evaluation is performed.

As a result, the color density is 1.5 or more. The color reproducibility and the highlight part reproducibility are equivalent to those of Example 1. Even if a photo-induced color forming toner is used, the color density, the color reproducibility, and the highlight part reproducibility showed superior characteristics, similarly to the non-photo-induced color forming toner of Example 1.

TABLE 2

| | | Color | | | | | | | |
|---|---|---|---|---|---|---|---|---|---|
| | | Y color | M color | C color | R color | G color | B color | K color | W color |
| LED | 405 nm | X | | | X | X | | X | |
| wavelength | 532 nm | | X | | X | | X | X | |
| | 657 nm | | | X | | X | X | X | |

Comparative Example 1

Production of Toner

Firstly, a microcapsule containing sheet described in Japanese Patent Publication No. 2979158 is produced. Specifically, polyurethane is used as a wall material of the microcapsule, and a phospholipid bimolecular film associated with azobenzene as the photoisomerizing substance is embedded in micropores in this wall material. Moreover, a leuco dye is contained in this microcapsule, which is dispersed in methylcellulose containing α-naphthol as a developer, and made into a sheet.

The above sheet is cut into small pieces, and further milled by a jet mill, to produce particles having an average particle diameter of about 20 μm. It is treated with an external additive in the same manner as the above, to make a toner, which is further mixed with the carrier, so as to make the developing agent 4.

All of these steps are performed in the dark.

(Evaluation)

Image Formation is performed in the same manner as Image Formation of Example 4, except that the developing agent 4 is used instead of the developing agent 3, and the same Image Evaluation is performed. Moreover, Image Formation is performed in the same manner as above except that the linear velocity of the photoreceptor is set to 300 mm/second, Furthermore, Image Formation is performed where an unfixed image is left for 10 minutes in the dark, then fixed and irradiated with light.

As a result, the density of the obtained print sample is weak as a whole (image density: average about 0.8), when the linear velocity of the photoreceptor is 10 mm/second, and splash of the highlight part is remarkable. Moreover, when the linear velocity of the photoreceptor is 300 mm/second, although the image density and the tone are recovered (image density: average about 1.0), splash of the highlight part is observed. In particular, in a half tone image of 20% or less, splash is remarkable. Furthermore, the print sample left for 10 minutes in the dark does not form a color so much, and is not able to be judged as an image.

As described above, in the image forming apparatus (image forming method) using the toner of an aspect of the present invention in the Examples, even if the linear velocity of the photoreceptor is largely changed, the image is stable without any change. Moreover, the reproducibility in a highlight image part is also excellent and a high definition image may be obtained. On the other hand, when the toner of the Comparative Examples having a different color formation mechanism from that of an aspect of the present invention is used, a stable image can not be obtained even with the same device structure.

The foregoing description of the embodiments of an aspect of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. An image forming apparatus comprising:

an image holding member;

a toner image formation device that forms a toner image on a surface of the image holding member using a toner, the toner including a first component and a second component that are present separately from each other and form a color when reacted with each other, and a photocurable composition containing either one of the first component and the second component, the photocurable composition being cured or maintained in an uncured state by applying color forming information, to control the reaction for color formation;

a transfer device that transfers the toner image formed on the image holding member surface onto a recording medium surface;

a color forming information applying device that applies color forming information to the toner image;

a fixing device that fixes the toner image transferred onto the recording medium surface; and a color formation device that forms a color of the toner image applied with the color forming information, wherein the image holding member is provided with a reflection device that reflects the light for applying the color forming information to the toner image formed on the image holding member surface toward the toner image again.

2. The image forming apparatus according to claim 1, wherein the fixing device also functions as the color formation device.

3. The image forming apparatus according to claim 1, wherein the image holding member is a photoreceptor, and the toner image formation device includes:

a charging device that charges a surface of the photoreceptor;

an exposure device that forms an electrostatic latent image on the surface of the photoreceptor by exposing the photoreceptor to light; and a development device that develops the electrostatic latent image using a developing agent containing the toner and forms a toner image.

4. The image forming apparatus according to claim 1, further comprising a photo irradiation device that irradiates light onto the recording medium surface that the toner image has been fixed on.

5. The image forming apparatus according to claim 1, wherein the toner contains a microcapsule dispersed in the photocurable composition, the first component is contained in the microcapsule, and the second component is included in the photocurable composition.

6. The image forming apparatus according to claim 5, wherein the photocurable composition contains the second component and a polymerizable compound.

7. The image forming apparatus according to claim 5, wherein the second component contains a photopolymerizable group.

* * * * *